US008679293B2

(12) United States Patent
Ding et al.

(10) Patent No.: US 8,679,293 B2
(45) Date of Patent: Mar. 25, 2014

(54) SYSTEM AND METHOD FOR OPTIMIZING LIGNOCELLULOSIC GRANULAR MATTER REFINING

(75) Inventors: Feng Ding, Québec (CA); Ilich Lama, Québec (CA); Richard Gagnon, Québec (CA); Claude Lejeune, Québec (CA)

(73) Assignee: Centre de Recherche Industrielle du Quebec, Quebec, Quebec (CA)

( * ) Notice: Subject to any disclaimer, the term of this patent is extended or adjusted under 35 U.S.C. 154(b) by 829 days.

(21) Appl. No.: 12/598,644

(22) PCT Filed: May 2, 2008

(86) PCT No.: PCT/CA2008/000857

§ 371 (c)(1),
(2), (4) Date: Nov. 3, 2009

(87) PCT Pub. No.: WO2008/134885

PCT Pub. Date: Nov. 13, 2008

(65) Prior Publication Data

US 2010/0121473 A1 May 13, 2010

(30) Foreign Application Priority Data

May 4, 2007 (CA) ..... 2588050
Feb. 5, 2008 (CA) ..... 2619904

(51) Int. Cl.
*D21C 7/12* (2006.01)

(52) U.S. Cl.
USPC ..... 162/61; 162/49; 162/238; 700/104

(58) Field of Classification Search
USPC ..... 162/49, 61, 238
See application file for complete search history.

(56) References Cited

U.S. PATENT DOCUMENTS 3,947,668 A 3/1976 Al-Shaikh et al.
3,983,403 A 9/1976 Dahlström et al.

(Continued)

FOREIGN PATENT DOCUMENTS

WO 9420671 A1 9/1994

OTHER PUBLICATIONS

Du Huaijing,Doctoral Thesis: Multivariable Predictive Control of a TMP Plant, Oct. 1998, University of British Columbia.*

(Continued)

*Primary Examiner* — Anthony Calandra
(74) *Attorney, Agent, or Firm* — Jean-Claude Boudreau

(57) ABSTRACT

A system and method for optimizing a process for refining lignocellulosic granular matter such as wood chips use a predictive model including a simulation model based on relations involving a plurality of matter properties characterizing the matter such as moisture content, density, light reflection or granular matter size, refining process operating parameters such as transfer screw speed, dilution flow, hydraulic pressure, plate gaps, or retention delays, at least one output controlled to a target such as primary motor load or pulp freeness, and at least one uncontrolled output such as specific energy consumption, energy split, long fibers, fines and shives. An adaptor is fed with measured values of matter properties and measured values of controlled and uncontrolled outputs, to adapt the simulation model accordingly. An optimizer generates a value of the target according to a predetermined condition on a predicted uncontrolled output parameter and to one or more process constraints.

18 Claims, 29 Drawing Sheets

(56) References Cited

U.S. PATENT DOCUMENTS

| | | | |
|---|---|---|---|
| 4,148,439 | A | 4/1979 | Flodén |
| 4,184,204 | A | 1/1980 | Flohr |
| 4,301,373 | A | 11/1981 | Sjödin |
| 4,392,204 | A | 7/1983 | Prim et al. |
| 4,498,137 | A | 2/1985 | Flohr |
| 4,500,203 | A | 2/1985 | Bieringer |
| 4,661,911 | A | 4/1987 | Ellery, Sr. |
| 4,691,365 | A | 9/1987 | Nagashima |
| 4,692,210 | A | 9/1987 | Forrester |
| 4,803,371 | A | 2/1989 | Durland |
| 4,806,014 | A | 2/1989 | Einarson et al. |
| 4,886,576 | A | 12/1989 | Sloan |
| 4,943,347 | A | 7/1990 | Floden |
| 5,011,088 | A | 4/1991 | Savonjousi |
| 5,011,090 | A | 4/1991 | Savonjousi |
| 5,016,824 | A | 5/1991 | Pietinen et al. |
| 5,500,088 | A | 3/1996 | Allison et al. |
| 5,540,392 | A | 7/1996 | Broderick et al. |
| 5,544,757 | A | 8/1996 | Geiger et al. |
| 5,949,086 | A | 9/1999 | Reponen et al. |
| 5,960,104 | A | 9/1999 | Conners et al. |
| 6,122,065 | A | 9/2000 | Gauthier |
| 6,175,092 | B1 | 1/2001 | Binette et al. |
| 6,199,463 | B1 | 3/2001 | Quick |
| 6,336,602 | B1 | 1/2002 | Miles |
| 6,398,914 | B1 | 6/2002 | Furumoto |
| 6,447,146 | B1 | 9/2002 | Skinner et al. |
| 6,466,305 | B1 | 10/2002 | McBain |
| 6,577,916 | B1 | 6/2003 | Gehr et al. |
| 6,752,165 | B2 | 6/2004 | Johansson |
| 6,778,936 | B2 | 8/2004 | Johansson |
| 6,846,381 | B2 | 1/2005 | Jussila et al. |
| 6,938,843 | B2 | 9/2005 | Johansson |
| 7,082,348 | B1 | 7/2006 | Dahlquist et al. |
| 7,085,615 | B2 | 8/2006 | Persson et al. |
| 7,130,040 | B2 | 10/2006 | Lindgren et al. |
| 7,240,863 | B2 | 7/2007 | Ettaleb et al. |
| 7,292,949 | B2 | 11/2007 | Ding |
| 2003/0009894 | A1 | 1/2003 | Yamamoto |
| 2003/0079544 | A1 | 5/2003 | Floyd |
| 2004/0025654 | A1 | 2/2004 | Olsen |
| 2005/0103453 | A1 | 5/2005 | Kankaanpaa |
| 2005/0120840 | A1 | 6/2005 | Koskovich |
| 2005/0190958 | A1 | 9/2005 | Woods et al. |
| 2005/0263259 | A1 | 12/2005 | Sidhu et al. |
| 2006/0201582 | A1 | 9/2006 | Edwards |
| 2006/0278353 | A1 | 12/2006 | Ding |
| 2006/0285336 | A1 | 12/2006 | Davies |
| 2007/0143066 | A1 | 6/2007 | Floyd et al. |
| 2007/0158040 | A1 | 7/2007 | Benaoudia et al. |
| 2007/0236680 | A1 | 10/2007 | Barker |

OTHER PUBLICATIONS

Allison et al "Dual adaptive control of chip refiner motor load" Pulp and Paper Canada, 96:3, T73-T79, 1995.

Berg et al "Deterministic consistency estimation in refining processes" Int. Mechanical Pulping Conference, Quevec, Canada, pp. 361-366, 2003.

Bergman "On-line chip analysis : new technology for an improved pulping process" Pulp and paper Canada, 99(12) pp. T453-T454, 1998.

Breck et al "Thermomechanical Pulping—a Preliminary Optimization", Transactions, Section technique, ACPPP, 1 3, pp. 89 95, 1975.

Brill "Effects of wood and chip quality on TMP properties" IMPC proceedings, Stockholm, pp. 153-162, 1985.

Cluett et al "Control and optimization of TMP refiners" Pulp and Paper Canada,96:5, T158-T162, 1995.

Ding et al "Improvement and Prediction of Kraft Pulp Yield Using a Wood Chip Quality Online Measurement System (CMSE)" Control Systems 2006.

Ding et al "Online Wood Chip Quality Measurement: Chip Density and Wood Species Variation" IMPC 2005.

Ding et al "Wood Chip Physical Quality Definition and Measurement" IMPC 2003.

Ding et al "Effects of some wood chip properties on pulp qualities" Pulp and Paper Annual Conference Proceedings, p. 35 , Jan. 29, 2003.

Ding et al "Economizing the Bleaching Agent Consumption by Controlling Wood Chip Brightness" Control Systems 2002.

Du et al "Nonlinear control of a wood chip refiner" Proceedings of the IEEE Conference on Control Applications. Albany, NY : IEEE. p. 1065 1066 , 1995.

Dumont et al "Wood chip refiner control" IEEE Control Syst. Mag. 8:2. 38 43 1988.

Eriksen et al "Consequences of Chip Quality for Process and Pulp Quality in TMP Production", International Conference, Mechanical Pulping, Oslo, Jun. (1981).

Evans et al "Refiner control effectively accomplished through adaptive control" Pulp & Paper Canada. 96:5. T163 T166, 1995.

Fisher et al "The interface between design and control. 1. Process controllability . 2. Process operability , 3. Selecting a set of controlled variables." Ind. Eng. Chem. Res. 27:597 615, 1988.

Fu et al "Chip refiner motor load adaptive control using a nonlinear Laguerre model" Second IEEE Conference on Control Applications. Vancouver, B. C. P. 371 376, 1993.

Fuglem et al "Influence of spruce properties on thermomechanical pulping Pilot scale result", International Mechanical Pulping Conference, Proceedings, 7582, 2003.

Hartler ">> Wood quality requirements in mechanical pulping" Nordic pulp and paper research journal, No. 1, pp. 4-10, 1996.

Hatton "Chip quality monograph—Chapter 14 : Chip quality analytical procedures" Joint textbook committee of the paper industry . pp. 303-323 (1999).

Hill et al "On the control of chip refining systems" Pulp and paper Canada , 94 (6), pp. T161-T165, 1993.

Hoekstra et al "The Effects of Chip Size on Mechanical Pulp Properties and Energy Consumption", International Conference, Mechanical Pulping, Washington, Jun. 1983.

Ingman "Utilization of Neural Network Technology for Some Pulp & Paper Industry Applications" 2000 Process Control, Electrical & Info. Conference Proceedings, 2000.

Jensen et al "Effect of Chip Quality on Pulp Quality and Energy Consumption in RMP Manufacture", Int symp. on fundamental concepts of refining, Appleton Wis., Sep. (1980).

Jones "Simulating the Development of pulp and Paper Properties in Mechanical Pulping Systems" Pulp and paper Can. 89(6): T214, 1988.

Jones "Simulation of the Performance of a TMP Mill" Pulp and paper Can. 91(2) : T81,1990.

Karrila et al "Review, Developments and Pulp and Paper Research Applications of Data Reduction with Neural Networks" Proceedings of Tappi Paper Summit, Atlanta, GA, Mar. 4-6, 2002.

Kooi et al. ,"Control of Wood Chip Refiner Using Neural Networks" Tappi Journal, pp. 156 162, Jun. 1992.

Lama et al "Applying controllability techniques to analyze a white water network for improved productivity in integrated newsprint mills" Resources Conservation and Recycling, 37(3), p. 181-192, 2003.

Lama et al "Modeling the effect of plate age on the operation of TMP refiners" Conference Paper—Pulp and Paper Association PAPTAC, 2006.

Lama et al "Controllability analysis of a TMP newsprint refining process" Control Systems 2004 Conference, 2004; Pulp and Paper Canada, 107(10), 2006.

Lama et al "Analyzing the directionality of TMP Refining interactions" Tappi Journal, 2006.

Lama et al "A methodology to model TMP Newsprint refiners" Tappi Journal, 2006.

Lama et al (2006) "Optimal Operation of TMP-Newsprint Refiners" Nordic Pulp & Paper Research Journal, 21(4), p. 534-541, 2006.

Lama et al "An Empirical Model for Predicting Motor Load Changes Due to Plate Wear in TMP-Refiners" Nordic Pulp & Paper Research Journal, 21(4), p. 527-533, 2006.

(56) References Cited

OTHER PUBLICATIONS

Lama et al "Determining the inherent potential for specific energy reduction and variability attenuation in TMP-refining operations" Nordic pulp and paper research journal, 2007, vol. 22, No. , pp. 299-306.
Lanouette et al "Effect of Woodchips Characteristics on the Pulp and Paper Properties by the Use of Pls Analysis" EXFOR 2004.
Lanouette et al Amélioration de la Stabilité des Raffineurs et de la Qualité de Pâte par un suivi des copeaux << Les papetières du Québec, pp. 29-33, Dec. 2003.
Laperriere et al "Modeling and simulation of pulp and paper quality characteristics using neural networks" Tappi Journal , 84 (10), 59, 2001.
Laperriere et al "Chip Properties Analysis for Predicting Bleaching Agents Requirements" Tappi Fall Technical Conference, 2003.
Laperriere et al "Implementing Optimization with Process Simulation" Tappi Journal, vol. 1, No. 4, Jun. 2002.
Lecourt et al "Modeling TMP fibre morphology and pulp properties from wood and forest data: The example of Norway spruce significant" International Mechanical Pulping Conference , Proceedings , 67 75, 2003.
McQueen et al "Identification of a TMP wod chip refiner with implications for process control" Tappi journal, May 1999.
Marton et al "Energy Consumption in Thermomechanical Pulping", Tappi, 64 8, p. 71, 1981.
Miles "Refining intensity and pulp quality in high-consistency refining" Paperi ja Puu. 72:5. 508 514, 1990.
Miles et al "The flow of pulp in chip refiners" J. Pulp & Paper Sci. 16:2. J63 J72, 1990.
Miles et al "Refining intensity, energy consumption, and pulp quality in two stage chip refining" Tappi J. 74:3. 221 230, 1991.
Miles et al. "Wood characteristics and energy consumption in refiner pulps", 1995.
Petersson et al "On line measurement of wood chip size" Tappi J. 71(7), 78 81,1988.
Qian et al "Optimization of a wood chip refining process based on fuzzy relational models" Computers chem.. eng., vol. 21, pp. S1137-S1142, 1997.
Qian et al "Modeling of a Wood-Chip Refiner Using Artificial Neural Networks" Tappi journal vol. 78, No. 6, 1995.
Roche et al "A Practical approach to the control of TMP refiners" Proceedings of the '96 Control Systems Conference, Montréal, Canada : TAPPI Press. p. 129 135 ,1996.
Rogers et al "Automatic control of chip refining" Pulp & Paper Canada. 81:10. T277 T282, 1980.
Saltin et al "Improving the Reliability of Newsprint Quality Data Using Integrated Factor Networks for Paper Machine Control and Analysis", Engineering Conference Proceedings, Boston, pp. 55-61, 1992.
Saltin et al "Analysis and control of newsprint quality and paper machine operation using integrated factor networks: technique can help to identify source of quality changes" Pulp & paper Canada, CPPA. Technical Section. Control systems 1992 conference, Whistler BC , Canada, vol. 96, No. 7, pp. 48-51, Sep. 28, 1992.
Sarimveis et al H. , "Artificial Intelligence Tools for the On-Line Prediction of Quality Properties in Pulp and Paper Processes", Paper Summit, Atlanta, GA, 2002.
Sidhu et al "Advances in mechanical pulping control and measurement" Paptac 91st Annual Meeting , Montréal, Canada : PAPTAC. p. D751 D755 ,2005.
Sidhu et al "Modeling and Advanced Control of TMP Refiner System" Control System 2004, pp. 107-112, 2004.
Stationwala et al "The Effect on First Stage Refining Conditions on Pulp Properties and Energy Consumption" Journal of Pulp and Paper Science: vol. 19, No. 1, pp. J12 J18, Jan. 1992.
Strand "Quality control of high-consistency refiners" Tappi journal, Vo. 81, No. 12, 1998.
Strand et al "Optimum design, operation and control of mechanical pulping systems" International Mechanical Pulping Proceedings, Washington, D.C. Tappi. p. 277 295, 1983.
Strand et al "Control and optimization of mechanical pulping systems" Tappi journal peer reviewed paper, 2000.
Strand "Factor Analysis as Applied to the Characterization of high yield Pulps" Tappi 1987 Pulping Conference Proceedings, Tappi Press, Atlanta, p. 61, 1987.
Strand et al. , "Millwide advanced quality control for the production of newsprint" IMPC conference, 2001.
Strand et al. "The Effect of production rate on specific energy consumption in high consistency chip refining" Proc. Intl. Mechanical Pulp Conf. Oslo, 1993.
Strand "Model based control of high consistency refining", Tappi Journal, vol. 79(10), pp. 140-146 , Oct. 1996.
Strand et al "Control of Refiner Operation Using Integrated Factor Networks" 1992 Pulping Conference Proceedings, pp. 595-590, 1992.
Strand "The Effect of Refiner Variation on Pulp Quality" International mechanical pulping conference, pp. 125-130, 1995.
Strand et al "On-line Control and optimization of the refining process using a model based control system" International mechanical pulping conference, pp. 101-108, 1991.
Liimatainen et al. ."Mechanical pulping: Papermaking science and technology series; Chapter 5 : Grinding and pressure grinding" Sundholm, vol. 5, Finland : Finnish Paper Engineers' Association and Tappi, pp. 107-156, 2000.
Tyrväinen "The influence of wood properties on quality of TMP made from Norway spruce (*Picea abies*)—Wood from old-growth forests, first-thinnings, and small chips" 1995 International mechanical pulping conference, pp. 23-34, 1995.
Wood "Chip Quality Effects in Mechanical Pulping ; A Selected Review" 1996 Pulping Conference, pp. 491-497.
Zhu et al "A neural Network for Modeling Pulp Process" Pulp and Paper Canada, 98:9, pp. T298-T301, 1997.
Miles et al "Wood quality and energy consumption in the production of refiner pulps", 1994 Tappi Pulping Conference, Proceedings, 401-425, 1994.

* cited by examiner

SYSTEM AND METHOD FOR OPTIMIZING LIGNOCELLULOSIC GRANULAR MATTER REFINING

FIELD OF THE INVENTION

The present invention relates to the field of lignocellulosic granular matter refining processes such as used for pulp and paper production and for wood fibreboard manufacturing.

BACKGROUND OF THE INVENTION

In the Thermomechanical Pulping Process (TMP), wood chips are used as lignocellulosic raw matter, and their properties such as species, freshness, size, density and moisture content are important factors affecting pulp quality, as stated by Smook in "Handbook for Pulp & Paper Technologies", Joint Textbook Committee of the Paper Industry, 54 (1982), and can have an impact on energy consumption and process stability as discussed by Garceau in "Pâtes Mécaniques et Chimico-Mécaniques. La section technique", PAPTAC, (1989) Montreal, Canada, pp. 101 (1989). The relations between the refining process and pulp quality have been exhaustively discussed by Miles in "Refining Intensity and Pulp Quality in High-Consistency Refining", Paperi ja Puu—Paper and Timber, 72(5): 508-514, (1990), by Stationwala et al. in "Effect of Feed Rate on Refining", Journal of Pulp and Paper Science: vol 20 no 8 (1994) and by Wood. in "Chip Quality Effects in Mechanical Pulping—A Selected Review" 1996 Pulping Conference pp. 491-495. Furthermore, the relations between refining process and chip properties have also been exhaustively discussed by Jensen et al. in "Effect of Chip Quality on Pulp Quality and Energy Consumption in RMP Manufacture", Int symp. on fundamental concepts of refining, Appleton Wis., Sep. (1980), by Breck et al. in "Thermomechanical Pulping—a Preliminary Optimization", Transactions, Section technique, ACPPP, 1-3, pp 89-95 (1975) and by Eriksen et al. in "Consequences of Chip quality for Process and Pulp Quality in TMP Production", International Conference, Mechanical Pulping, Oslo, June (1981).

According to a known control strategy, a feedback controller is used on the chip transfer screw feeder to control primary motor load, the dilution flow rate for the primary refiner being coupled with the screw feeding to operate on a constant ratio mode. Alternatively, the feedback controller can be used to control the motor load by acting upon the dilution flow rate on the basis of a pulp consistency measurement at the blow line of the primary refiner. In both cases, the variation of chip quality acts as an external disturbance affecting the motor load.

The TMP mills are large consumers of electrical energy. Disc refiners, typically powered by large 10-30 MW electric motors, are used to convert wood chips to high quality papermaking fibers. According to analysis results of M. Jackson et al. reported in "Mechanical Pulp Mill", Energy Cost Reduction in the Pulp and Paper Industry, Browne, T. C. tech. ed., Paprican (1999), the energy consumption for a 500 BDMT/D (Bone Dry Metric Ton per Day) single-line TMP mill at 2400 kWh/BDMT, which is typical for a TMP mill using black spruce chips for newsprint production, was estimated at 2160 KWh/ADt (KWatt-hour per Air Dry ton) which corresponds to 90% of the whole mill energy consumption. Since the TMP process is used in 80% of the newsprint production worldwide, energy consumption is a major issue in that industry.

Presently, variations in specific energy consumption (SEC), i.e. applied energy per unit of weight of wood chips on an oven-dry basis during refining, to obtain a desired pulp quality can be relatively high. Usually there is a range of desired quality values, such as provided by Canadian Standard Freeness (CSF) for example, with which the produced pulp must comply to satisfy customers' demand. In this range, the obtained CSF can sometimes be near the upper limit or the lower limit. When the value is near the lower limit of the desired range, this means that more energy is needed to reach the desired quality. When the value is near the upper limit, a minimal consumption of energy for an acceptable quality pulp is reached. For cost reduction and resource protection purposes, it is desirable that energy spent to produce a pulp of a desired quality is managed efficiently.

Refiners are also involved in the manufacturing of fibreboards made from various lignocellulosic granular matters including wood chips and mill waste matters such as wood shavings, sawdust or processed wood flakes (e.g. OSB flakes). While the respective post-refining steps of fiberboard manufacturing and pulp and paper processes are distinct, their refining modes of operation are similar, and cost reduction as well as resource protection are important issues for both processes, so that it is still desirable that energy spent to produce a pulp of a desired quality is managed efficiently.

SUMMARY OF THE INVENTION

According to a first broad aspect of the invention, there is provided a method for optimizing the operation of a lignocellulosic granular matter refining process using a control unit and at least one refiner stage, said process being characterized by a plurality of input operating parameters, at least one output parameter being controlled by said unit with reference to a corresponding control target, and at least one uncontrolled output parameter. The method comprises the steps of: i) providing a predictive model including a simulation model for the refining process and an adaptor for the simulation model, the simulation model being based on relations involving a plurality of matter properties characterizing lignocellulosic matter to be fed to the process, the refining process input operating parameters, the controlled output parameter and the uncontrolled output parameter, to generate a predicted value of the uncontrolled output parameter; ii) feeding the simulation model adaptor with data representing measured values of the matter properties and data representing measured values of said controlled and uncontrolled output parameters, to adapt the relations of said simulation model accordingly; and iii) providing an optimizer for generating an optimal value of the control target according to a predetermined condition on the predicted value of the uncontrolled output parameter and to one or more predetermined process constraints related to one or more of the matter properties, the refining process input operating parameters and the refining process output parameters.

According to a second broad aspect of the invention, there is provided a system for optimizing the operation of a lignocellulosic refining process using a control unit, at least one output parameter meter and at least one refiner stage, said process being characterized by a plurality of input operating parameters, at least one output parameter being controlled by said unit with reference to a corresponding control target, and at least one uncontrolled output parameter, the controlled output parameter and the uncontrolled output parameter being measured by said at least one output parameter meter to generate output parameter data. The system comprises means for measuring a plurality of matter properties characterizing lignocellulosic matter to be fed to the process, to generate matter property data, and a computer implementing a predictive model including a simulation model for said matter refining process which is based on relations involving said plurality of matter properties, said refining process input operating parameters, said controlled output parameter and said uncontrolled output parameter, to generate a predicted value of said uncontrolled output parameter, said computer further implementing an adaptor for said simulation model receiving said matter property data and said output parameter data to adapt the relations of said simulation model accordingly, said computer further implementing an optimizer for generating an optimal value of said control target according to a predetermined condition on said predicted value of said uncontrolled output parameter and to one or more predetermined process constraints related to one or more of said matter properties, said refining process input operating parameters and said refining process output parameters.

BRIEF DESCRIPTION OF THE DRAWINGS

Preferred embodiment of the proposed system and method for optimizing wood chips refining will be described below in view of the accompanying drawings in which.

DETAILED DESCRIPTION OF EMBODIMENTS

Figure 1:
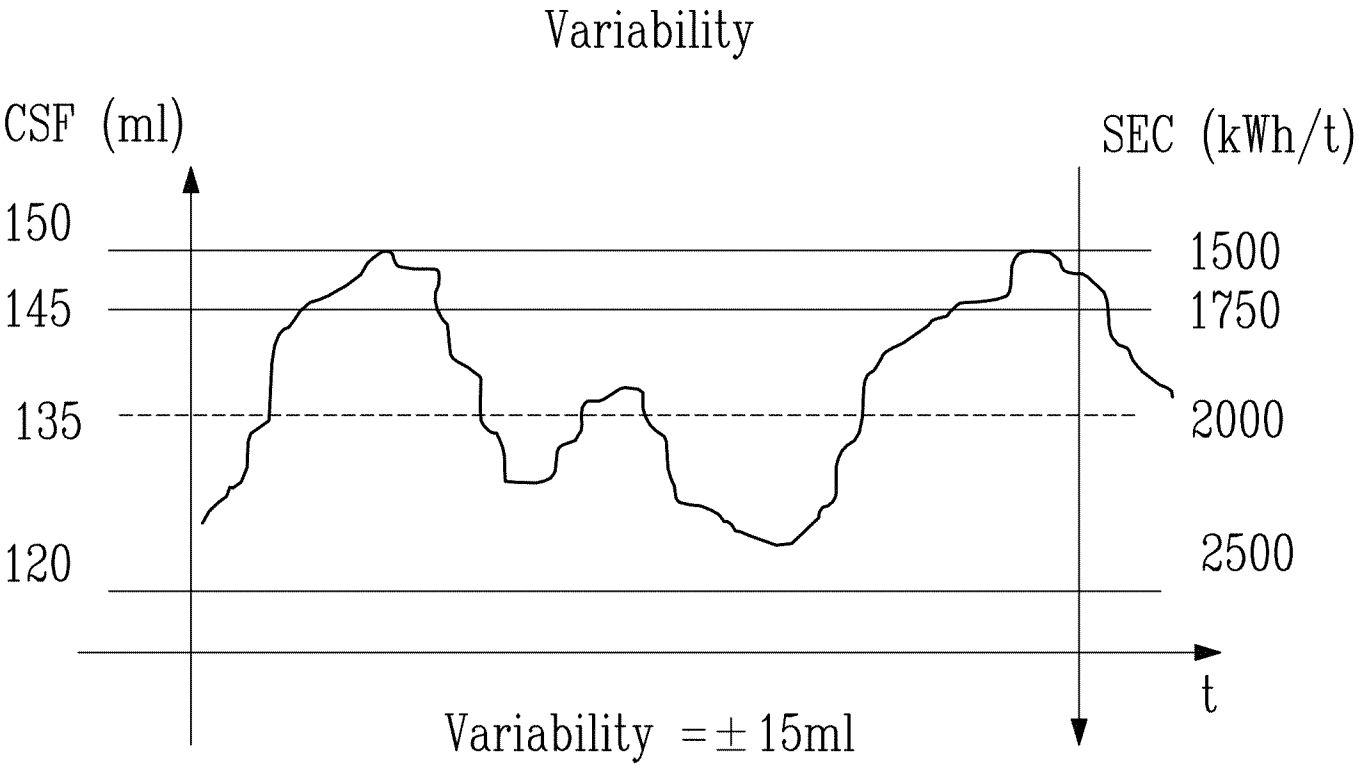
FIG. 1 is a graph showing an example of variability exhibited by CSF and SEC with time as observed using a conventional refiner control strategy.

Variations in properties of lignocellulosic raw matter can lead to large deviations in both quality of pulp produced therefrom as well as energy used to obtain it. In the TMP process, variations in wood chip properties lead to change in the mass flow rate of the chips fed into the refiner. Experiences have shown that for a normal operating condition, 30% of disturbances affecting the pulping process may be caused by these variations. Referring to the example shown in the graph of FIG. 1, CSF exhibits a variability of ±15 mL with reference to $CSF_{mean}$=135 mL, while SEC exhibits a variability of ±1500 kWh/t with reference to $SEC_{mean}$=2000 kWh/t. If the SEC variation could be minimized, it would be possible to produce a pulp of higher quality, e.g. $CSF_{mean}$=145 mL or approaching its upper limit (150 mL) for a same refining energy consumption, or to produce a pulp with same $CSF_{mean}$ value (135 mL) while consuming less energy. Usually, at the refiner stages, energy consumption does not only depend on chip quality and refining process control strategy. Energy consumption also depends on mill's design and its inherent process constraints. Under given operating conditions, there is usually a compromise to make between optimality in terms of controlled parameter variability reduction and process controllability. Minimizing the variability of a controlled parameter gives rise to a possibility of moving the operating point so as to reach a more optimal operation. Referring to the example of controllable area in the context of a refining process involving two degrees of freedom (controllable parameters) shown in the graph of FIG. 2, when the optimal operating point indicated at numeral 10 is out of the controllable area, a selected operating point as indicated at 12 must approach one or more process constraints represented by limit curves 14 as much as possible within the controllable area. That principle generally entails a reduction of controllability since the final margin for manoeuvring to stabilize the system upon external disturbance as represented by area 16 decreases accordingly as compared to the current margin for manoeuvring represented by area 18 around current operation point 20. Hence, if a mill has means to measure and control wood chip quality variability, the required margin for control is reduced, and the operating conditions can safely move closer the process constraints with more security, thus becoming more optimal. As a result, this may lead to a reduction of refining energy consumption.

Figure 3:
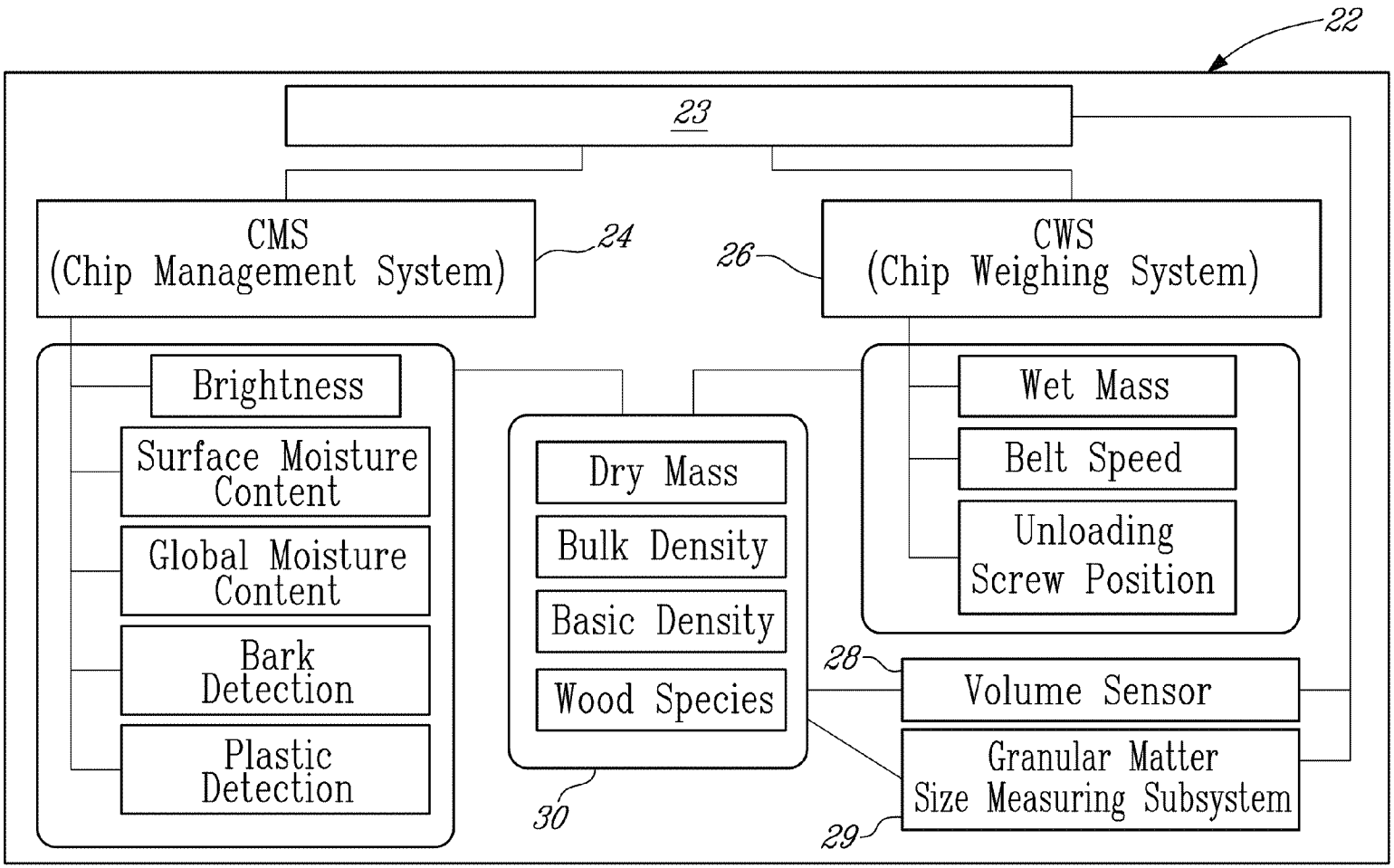
FIG. 3 is a schematic block diagram of the online chip quality measurement system that can be used to provide chip property data.
Figure 4:
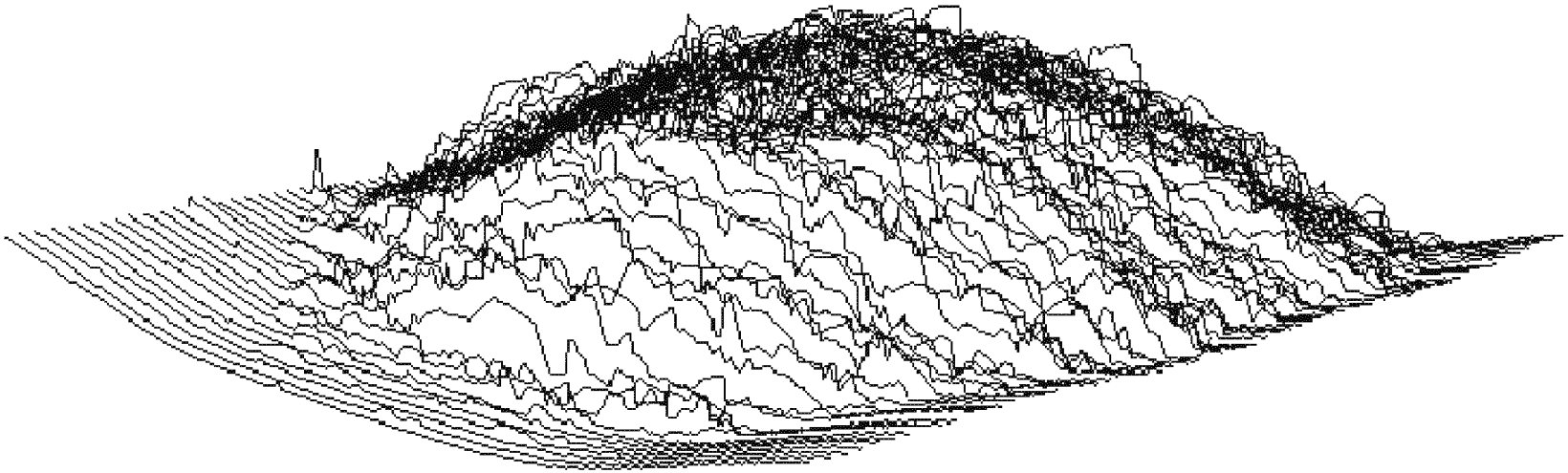
FIG. 4 is a typical volume representation provided by a volume sensor included in the system of FIG. 3.

Heretofore, the variation of chip quality acting as an external disturbance has not been considered when designing refiner control strategies. The proposed approach considers the relations between chip properties and pulp quality. For doing so, chip properties can be measured online using existing chip measurement systems, such the Chip Management System (CMS) as described in U.S. Pat. No. 6,175,092 B1 and in U.S. Pat. No. 7,292,949 B2, along with the Chip Weighing System (CWS) described in copending U.S. Patent application published under No. 2006/0278353 naming the present assignee, the entire content of all said Patent documents being incorporated herein by reference, all said systems being available from the present assignee. Referring to the schematic block diagram of FIG. 3 representing a chip quality online measurement system generally designated at 22 which includes a computer unit 23, the various chip characterizing properties measured by CMS at 24 includes brightness, surface moisture content, global moisture content, bark detection and plastic detection, while CWS at 26 provides wet mass, belt speed and unloading screw position data. Output parameters of CMS 24, CWS 26, and of a chip volume sensor at 28 such as described in the above cited U.S. application published under No. 2006/0278353, can be combined to derive dry mass, bulk density, basic density and wood species information as indicated in block 30. A typical volume representation provided by such volume sensor is shown in FIG. 4. Known applications of such measurement systems are further discussed in published U.S. Patent application published under no. 2004/0151361A1 and in the following papers: Ding et al. "Economizing the Bleaching Agent Consumption by Controlling Wood Chip Brightness", Control System 2002, Proceedings, June 3-5, Stockholm, Sweden, 2002, pp. 205-209; Ding et al. "Effects of some Wood Chip Properties on Pulp Qualities", 89th Annual Meeting PAPTAC. Montreal, 2003, pp. 37; Bédard et al. "Amélioration de la gestion de la cour à bois par la caractèrisation en ligne des copeaux", Congrès Francophone du Papier, Château Frontenac, Quéec, Canada, 14-16 mai, 2003, pp. 11-15; Ding et al. "Wood Chip Physical Quality Definition and Measurement", Pulp & Paper Canada, 2 (2005) 106, 27-32; Ding et al. "Online wood chip quality measurement: Chip density and wood species variation", IMPC 2005, June 7-9, Oslo, Norway, 2005, pp. 298-301; and Ding et al. "Improvement and Prediction of Kraft Pulp Yield Using a Wood Chip Quality Online Measurement System (CMSE)", Control Systems 2006, Proceedings, Jun. 6-8, 2006, Tampere, Finland, pp 123-128.

Figure 5:
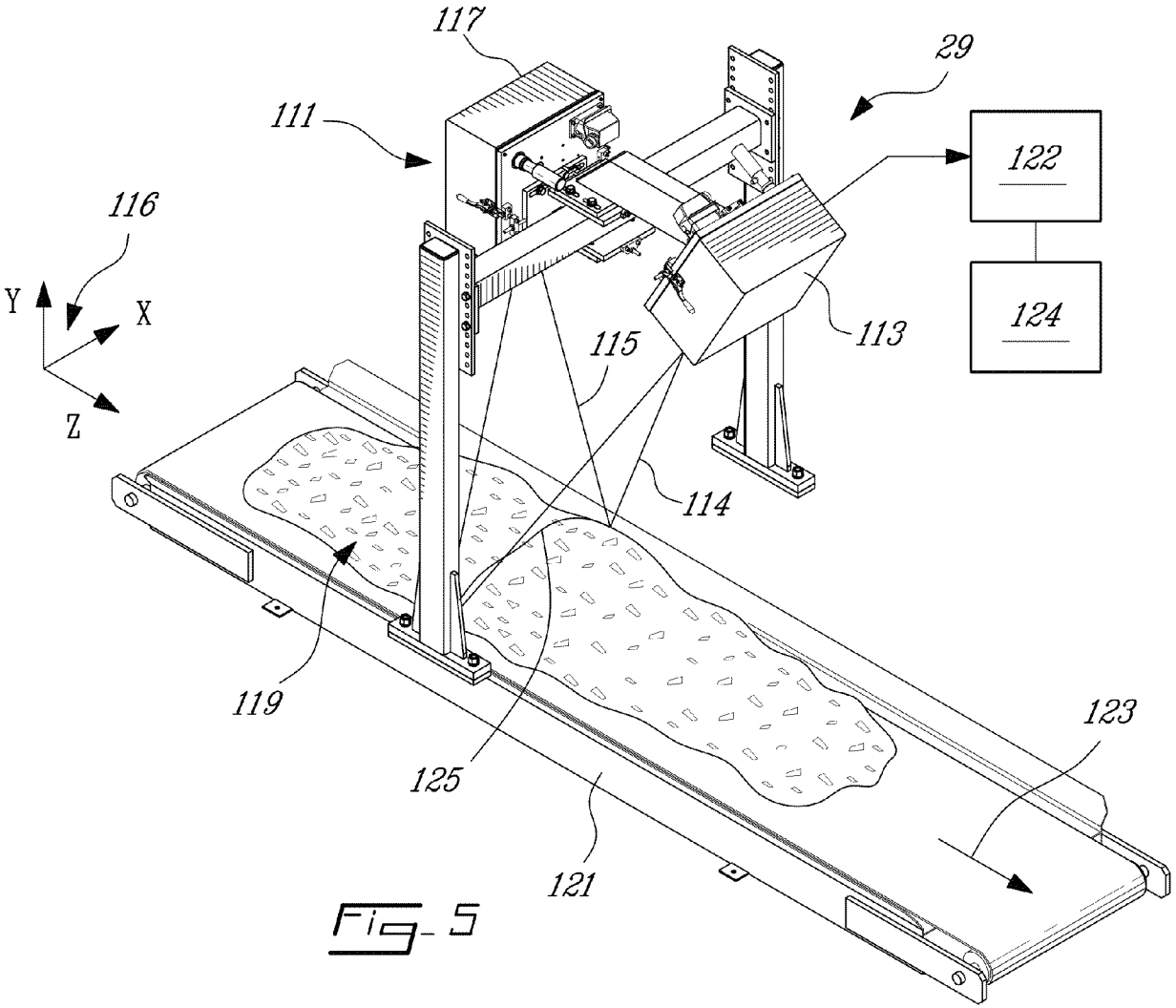
FIG. 5 is a perspective view of a granular matter size measuring subsystem provided on the system of FIG. 3.
Figure 6:
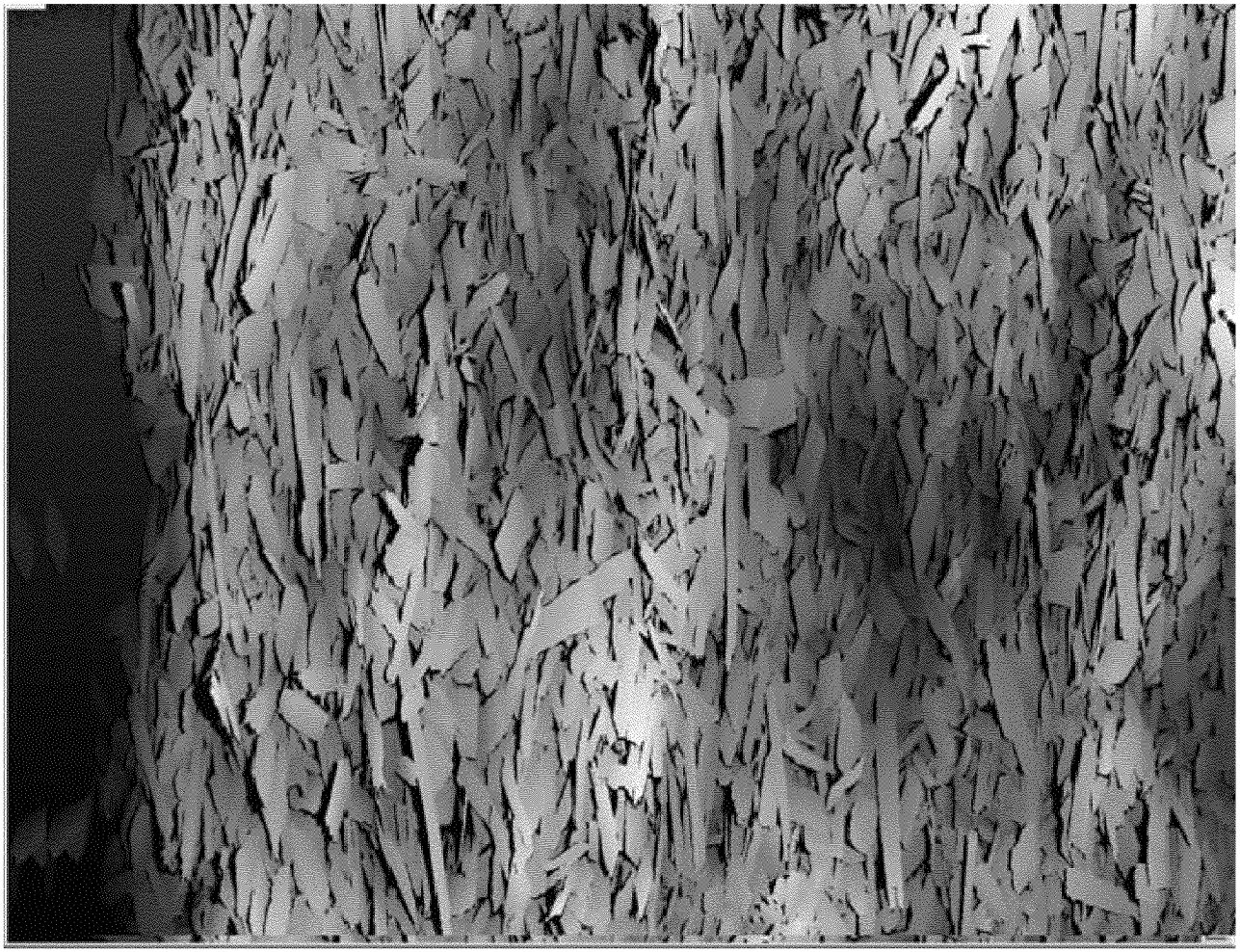
FIG. 6 is an example of raw 3D image obtained with the granular matter size measuring subsystem of FIG. 5.
Figure 7:
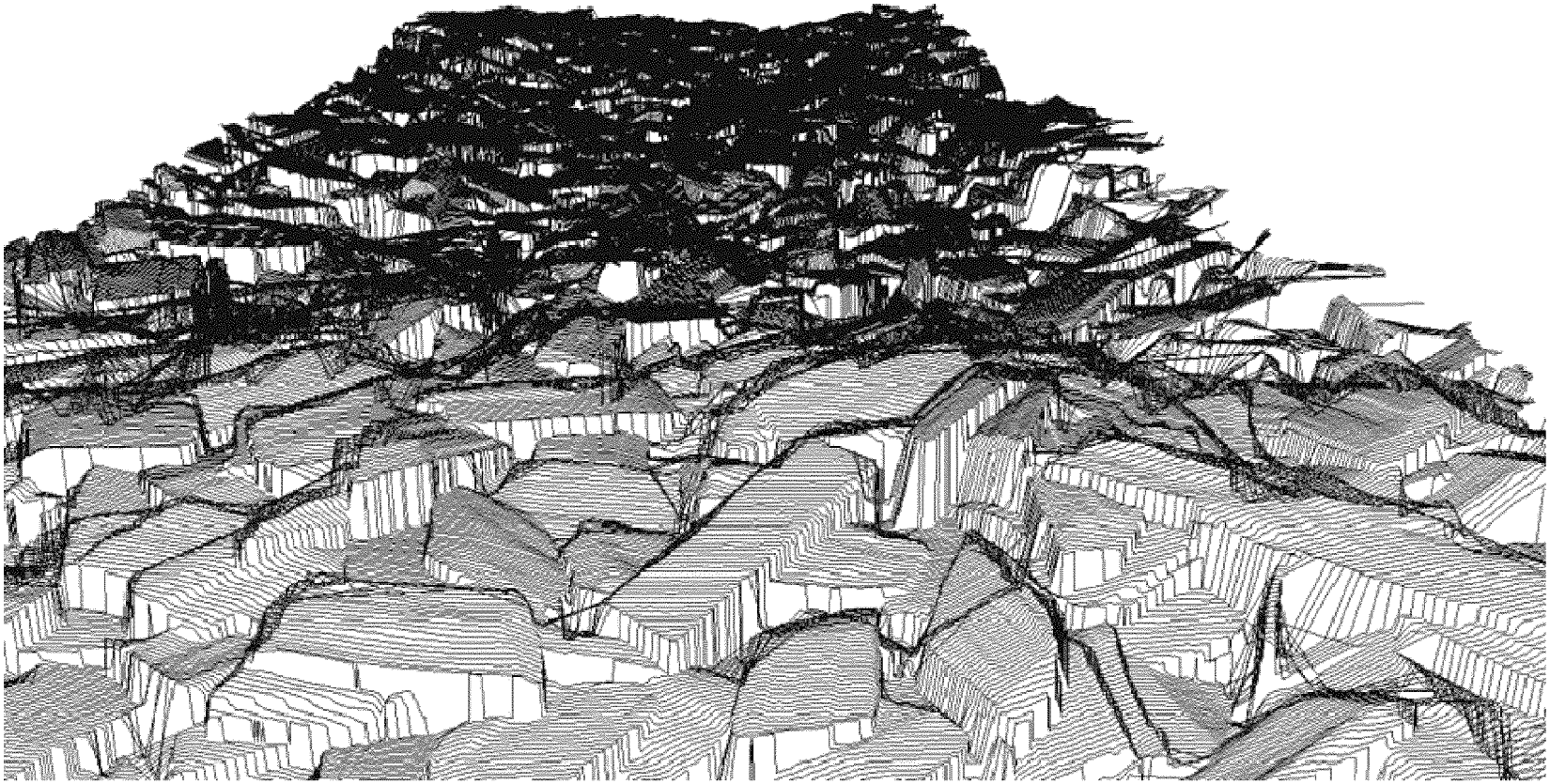
FIG. 7 is a conventional 3D representation of an image such as shown in FIG. 6.

Optionally, a granular matter size measuring subsystem as represented at 29 in FIG. 3, which uses a laser ranging device, can be provided to generate chip size information. The granular matter size measuring subsystem 29 will now described in more detail in view of FIGS. 5 to 18. It is to be understood that any other appropriate chip sizing apparatus available in the marketplace may be alternatively used, such as the Wip-Chip™ supplied by B & D Manufacturing (Chelmsford, Ontario, Canada), or the Scanchip™ from Iggesund Tools Inc. (Oldsmar, Fla.), with appropriate adaptation. The proposed granular matter size measuring subsystem 29 and associated measuring method use a three-dimensional (3D) imaging principle. Referring to FIG. 5, the subsystem 29 according to the shown embodiment includes a profile measuring unit 111 using a matrix camera 113 for capturing an image of a linear beam 115 projected by a laser source 117 onto the granular matter 119 moving under the field of vision 114 of camera 113, the matter 119 being transported on a conveyer 121 in the direction of arrow 123 in the example shown, which field of vision 114 forming a predetermined angle with respect to the plane defined by the laser beam 115. A linear array of pin-point laser sources could replace the linear laser source, and laser scanning of the surface of a still mass of granular matter could also be used. Since all points of the laser line 125 formed on the surface of matter 119 lay in a same plane, the height of each point of line 125 is derived through triangulation computing by the use of a pre-calculated look-up table, so to obtain the X and Y coordinates of the points on the surface of the inspected matter, in view of the 3D reference system designated at 116. The triangulation may be calibrated with any appropriate method, such as the one described in Canadian published patent application No. CA 2,508,595. Alternatively, such as described in Canadian patent no. CA 2,237,640, a camera with a field of vision being perpendicular to the X-Y plane could be used along with a laser source disposed at angle, upon adaptation of the triangulation method accordingly. The triangulation program can be integrated in the built-in data processor of camera 113 or integrated in the data processor of computer 122 provided on the subsystem 29, which computer 122 performs acquisition of raw image data and processing thereof in a manner described below, the images being displayed on monitor 124. The third dimension in Z is given by successive images generated by camera 113 due to relative movement of matter 119. Hence, a 3D image exempt from information related to the coloration of inspected granular matter is obtained, such as the raw image shown in FIG. 6, wherein the grey levels of the points in the image do not represent the hue of the imaged surface, but rather provide a height indication (clearer is the hue, higher is the point). FIG. 7 shows a conventional 3D representation of a raw image such as shown in FIG. 6.

Figure 8:
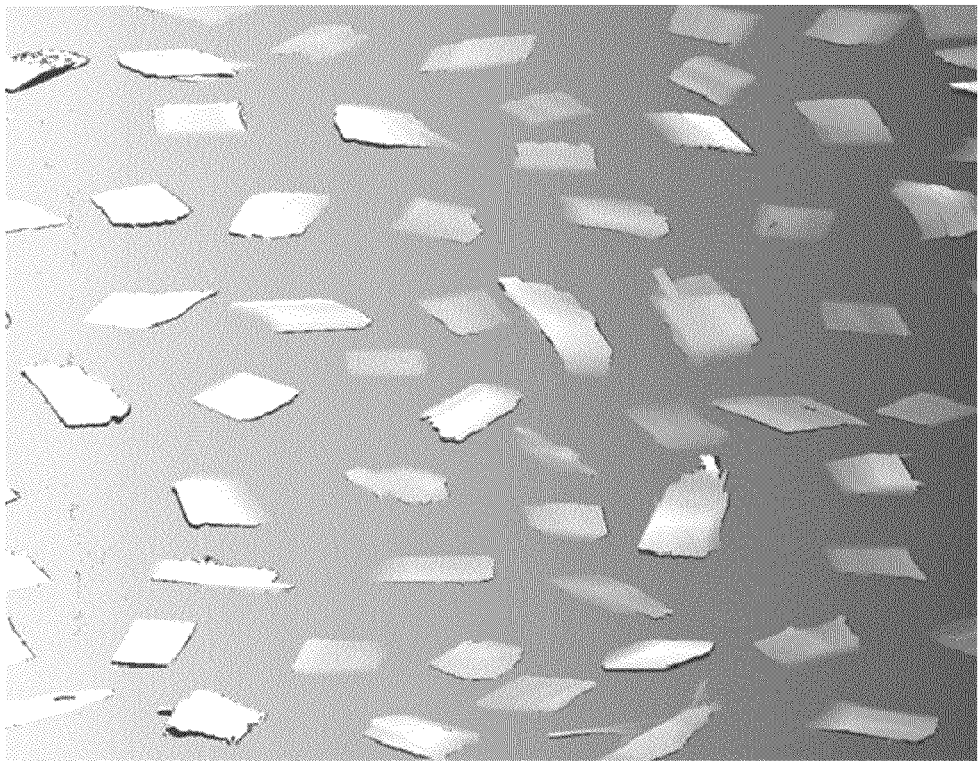
FIG. 8 represents a view of a wood chip sample spread on the surface of a conveyer for estimating the actual distributions of areas.
Figure 9:
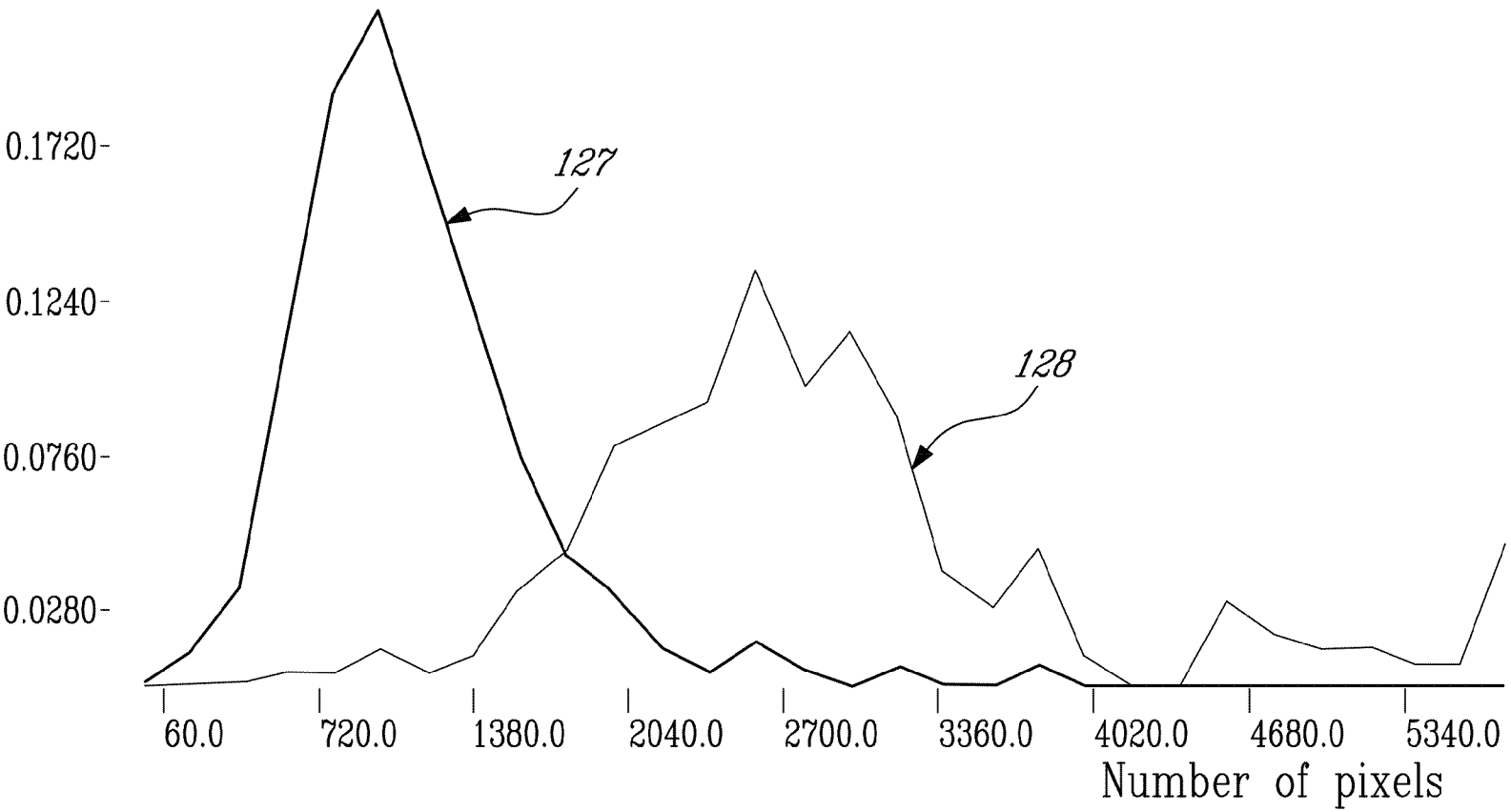
FIG. 9 is a graph presenting the curves of actual distributions of the areas of spread wood chips obtained from the batches sifted to 9.5 mm (⅜ in) and 22 mm (⅞ in)

According to the proposed approach, there is a one-to-one relation between the distribution of dimensions as measured on bulk matter through 3D image segmentation processing, and the actual distribution determined from the analysis of individual granules. That relation was confirmed experimentally from a sample of wood chips (hundreds of liters) that was sifted to produce five (5) batches of chips presenting distinct dimensional characteristics such as expressed by statistical area distributions. The actual distributions of chip areas were measured by spreading the chips on the conveyer in such a manner that they can be isolated as shown in FIG. 8. Ten (10) images for each chip batch enabled obtaining reliable statistical data associated with a sample of about two thousands (2000) chips. Since sifting separates chips according to a single dimension, a Gaussian (normal) area distribution was observed for each sifted batch, such as exhibited by curves 127 and 128 on the graph of FIG. 9, for the batches sifted to 9.5 mm (⅜ in) and 22 mm (⅞ in), respectively.

A good segmentation algorithm must exhibit an optimal trade-off between the capability of detecting with certainty a wholly visible chip without overlap, and the capability of isolating a maximum number of chips in a same image so that the required statistical data could be acquired in a sufficiently short period of time. Many 3D image segmentation methods have been the subject of technical publications, such as those described by Pulli et al in <<Range Image Segmentation for 3-D Object Recognition>> University of Pennsylvania—Department of Computer and Information Science, Technical Report No. MS-CIS-88-32, May 1988, and by Gachter in <<Results on Range Image Segmentation for Service Robots>> Technical Report, Ecole Polytechnique Fédérale de Lausanne—Laboratoire de Système Autonomes, Version 2.1.1, September 2005.

Figure 10:
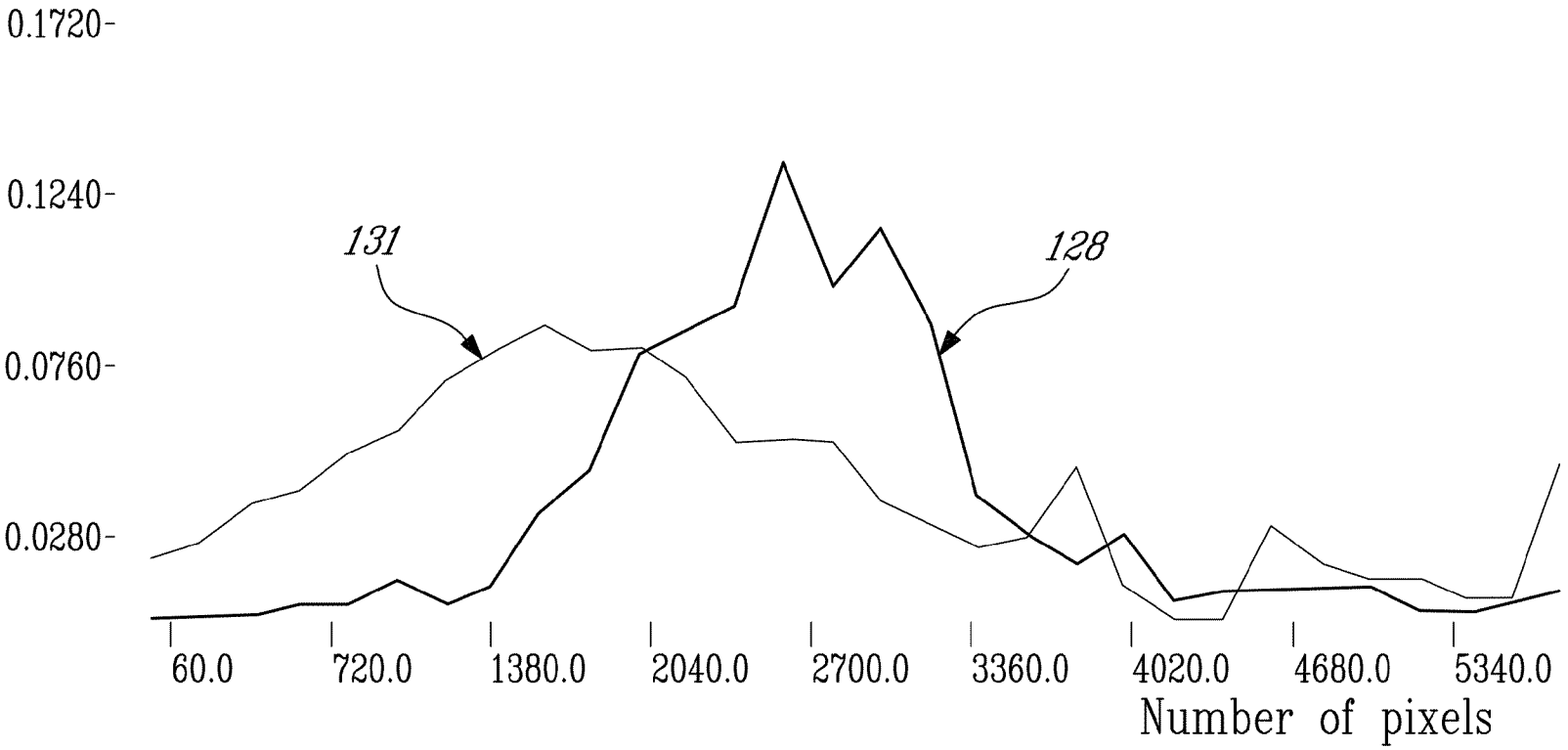
FIG. 10 is a graph presenting the curve of actual distribution of the areas of spread wood chips obtained from the batch sifted to 22 mm (⅞ in), and the curve of distribution estimated from a segmentation of 3D images of the same wood chips as inspected in bulk.
Figure 11:
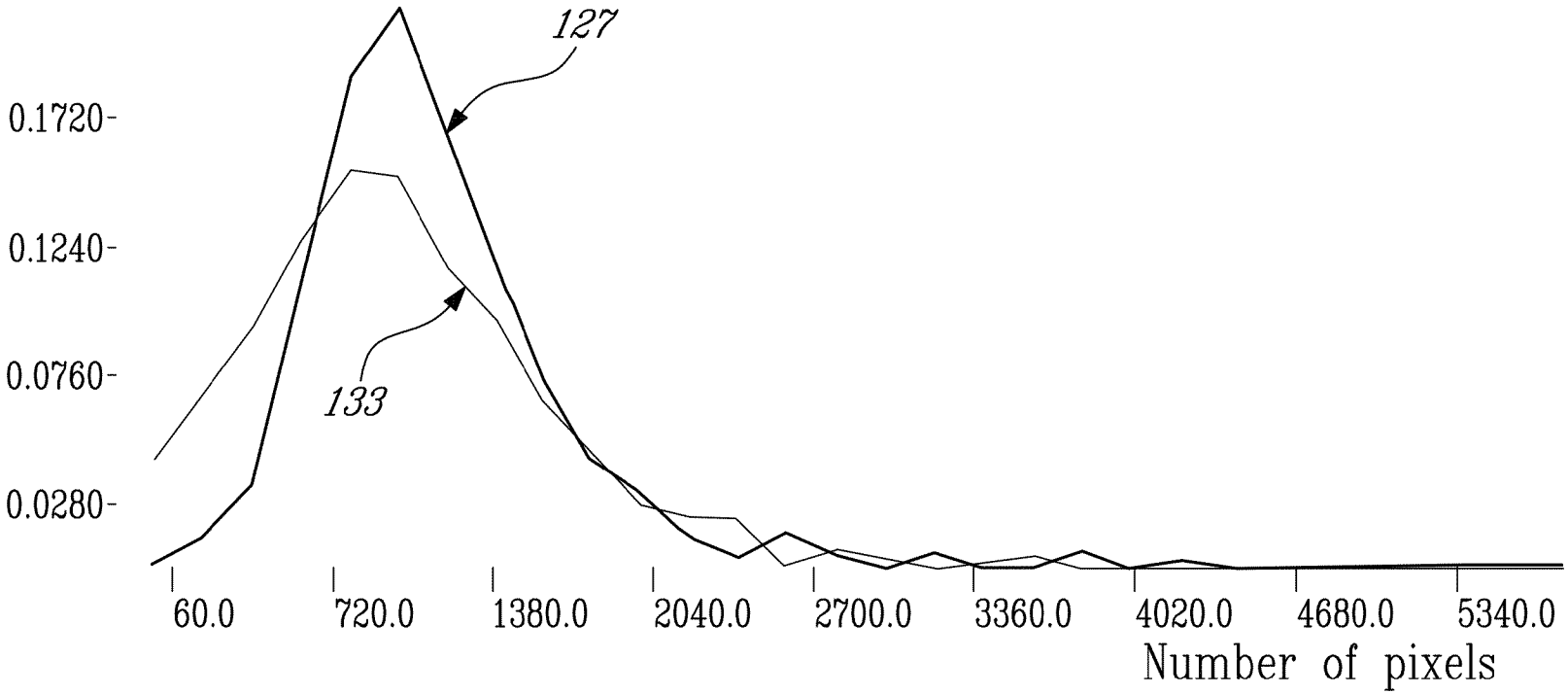
FIG. 11 is a graph presenting the curve of actual distribution of the areas of spread wood chips obtained from the batch sifted to 9.5 mm (⅜ in) of FIG. 5, and the curve of distribution estimated from a segmentation of 3D images of the same chips as inspected in bulk.

The graph of FIG. 10 presents the curve 128 of actual distributions for spread chips and curve 131 of distributions estimated from 3D image segmentation for chips from the batch sifted to 22 mm (⅞ in), using a basic segmentation method carried on by a program coded in C++ and executed by computer 122. The graph of FIG. 11 presents the curve 127 of actual distributions for spread chips and curve 133 of distributions estimated from 3D image segmentation for chips from the batch sifted to 9.5 mm (⅜ in). It can be observed from these graphs that estimations obtained with segmentation also provide a Gaussian distribution, but with a mean shifted toward the lowest values and with a higher spread (variance). Such bias can be explained by the fact that granules in bulk are found in random orientations thus generally reducing the estimated area for each granule on the one hand, and by the fact that the segmentation algorithm used would have a tendency to over-segmentation, on the other hand, thus favouring the low values. Notwithstanding that bias, at least for a Gaussian distribution, it is clear that a one-to-one relation exists between the distributions measured on chips in bulk and those of spread chips.

Figure 12:
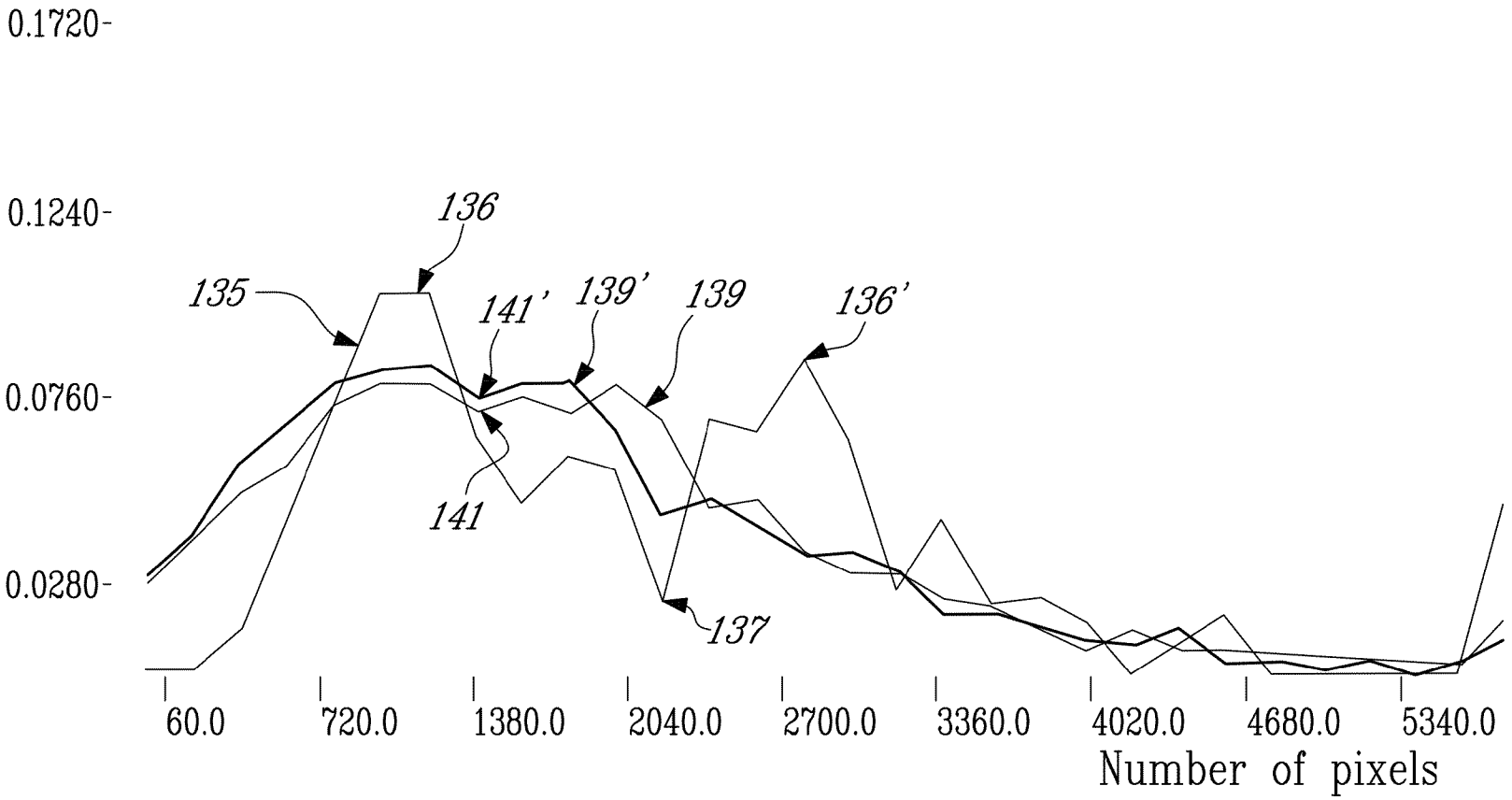
FIG. 12 is a graph presenting the curve of actual distribution of the areas of spread wood chips obtained from a mix of chips from the batches sifted to 9.5 mm (⅜ in) and 22 mm (⅞ in), and the curves of distributions of areas of the same chips as inspected in bulk following the segmentation of a set of images.
Figure 13:
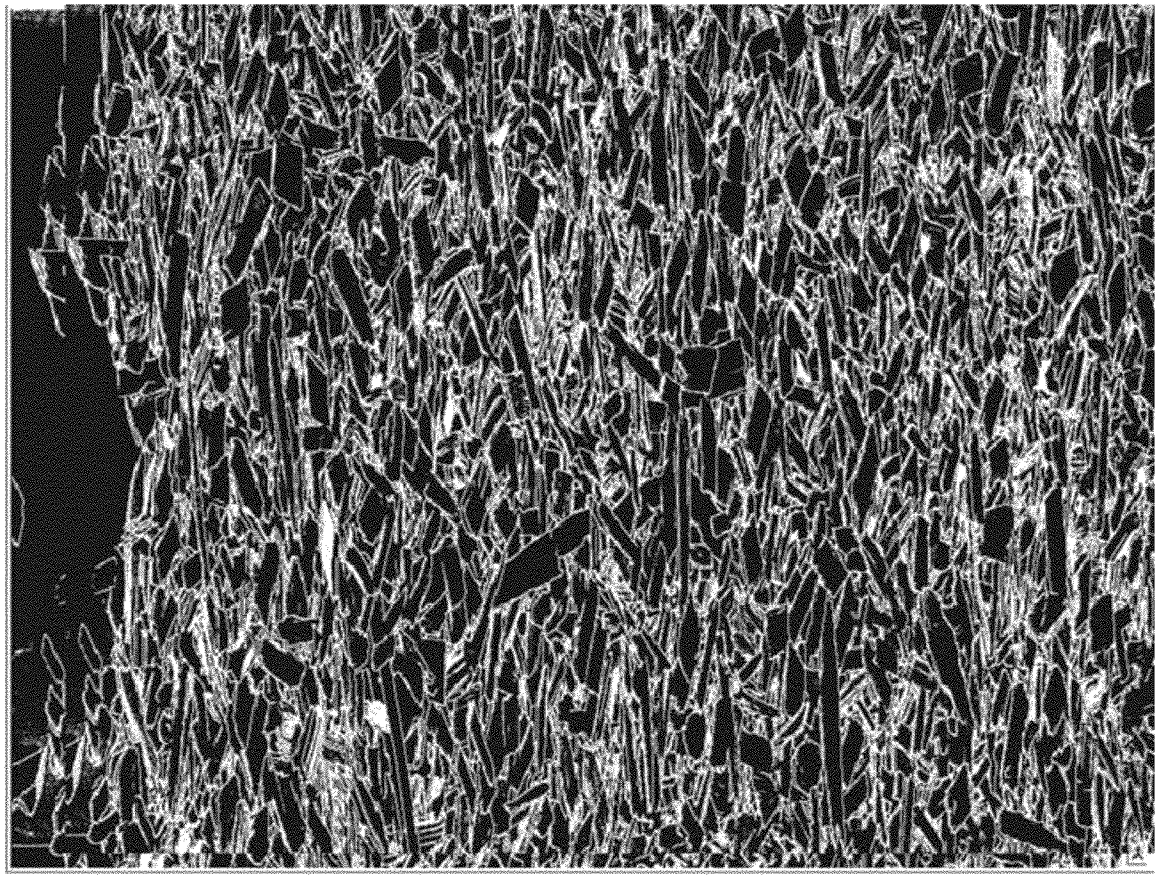
FIG. 13 is an example of 3D image processed with the application of a gradient during the segmentation step.

A chip sample characterized by a non-Gaussian distribution was produced by mixing chips form batches sifted to 9.5 mm (⅜ in) and 22 mm (⅞ in). The graph of FIG. 12 shows a curve 135 of distribution of areas obtained with spread chips. That distribution exhibits two (2) peaks 136 and 136' separated by a local minimum 137 associated with absence of chips from the 16 mm (⅝ in) group. Curves 139 and 139' of the same graph show the estimated distributions of areas following segmentation of sets of ten (10) and twenty (20) images of chips in bulk, respectively. Here again, one can observe a shift of means and a spread of peaks causing an overlap of the Gaussian distributions associated with the two batches of chips. Nevertheless, the presence of inflection points 141, 141' located near the apex of the distributions of curves 139, 139' indicates that two batches are involved, whose individual means can be estimated.

The experiences that were performed have demonstrated the reliability of estimation of area distribution for chips in bulk using 3D image analysis of chip surface. The estimations were found sufficiently accurate to produce chip size data usable for the control of pulp production process. That conclusion is valid provided that the chips located on top of an inspected pile of chips are substantially representative thereof as a whole, and that the segmentation induced bias is as constant as possible. In cases where some segregation of granules occurs on the transport line, a device forcing homogenization can be used upstream the measuring subsystem 10. Moreover, to the extent the granules are produced through identical or equivalent processes, one can assume that the granule characteristics influencing the segmentation bias are substantially constant. Nevertheless, in the case of wood chips, since it is possible that their forms vary somewhat with species, temperature at the production site or cutting tool wear, these factors may limit the final estimation accuracy. The spread of Gaussian distributions and the bias toward low values of mean area measurements can be reduced through geometric corrections applied on area calculations, which corrections, calculated with a 3D regression plane, consider the orientation of each segmented granule, as described below.

In the following sections, a more detailed description of image processing and analyzing steps is presented.

The segmentation step aims at identify groups of pixels associated with an image of distinct granules. In the example involving wood chips, starting with a 3D image such as shown in FIG. 6, a second image is generated by taking the absolute value of maximal gradient calculated pixel by pixel, considering the eight (8) nearer neighbouring pixels. The values are limited to a predetermined maximal value, to obtain a gradient processed image such as presented in FIG. 13.

Figure 14:
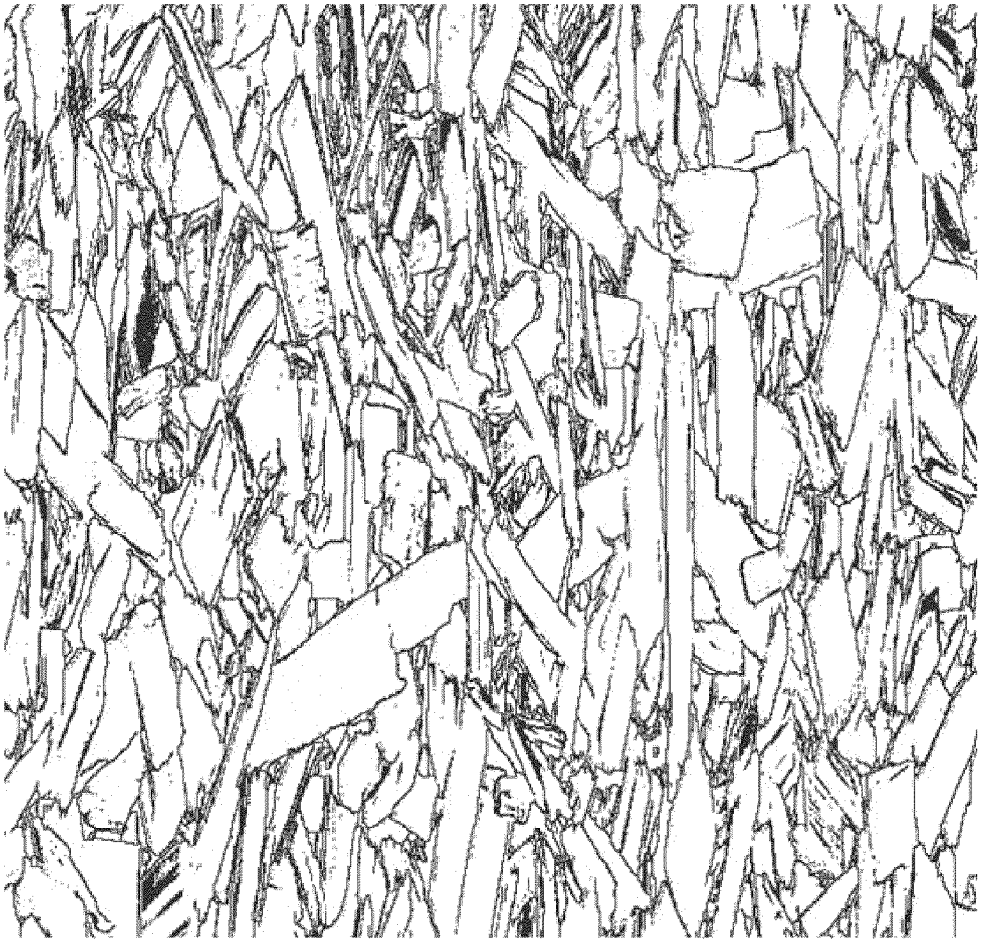
FIG. 14 is a portion of an inverted binary image obtained with thresholding from the image of FIG. 13.

Then, a thresholding is performed to generate an inverted, binary image such as the image portion shown in FIG. 14.

Figure 15:
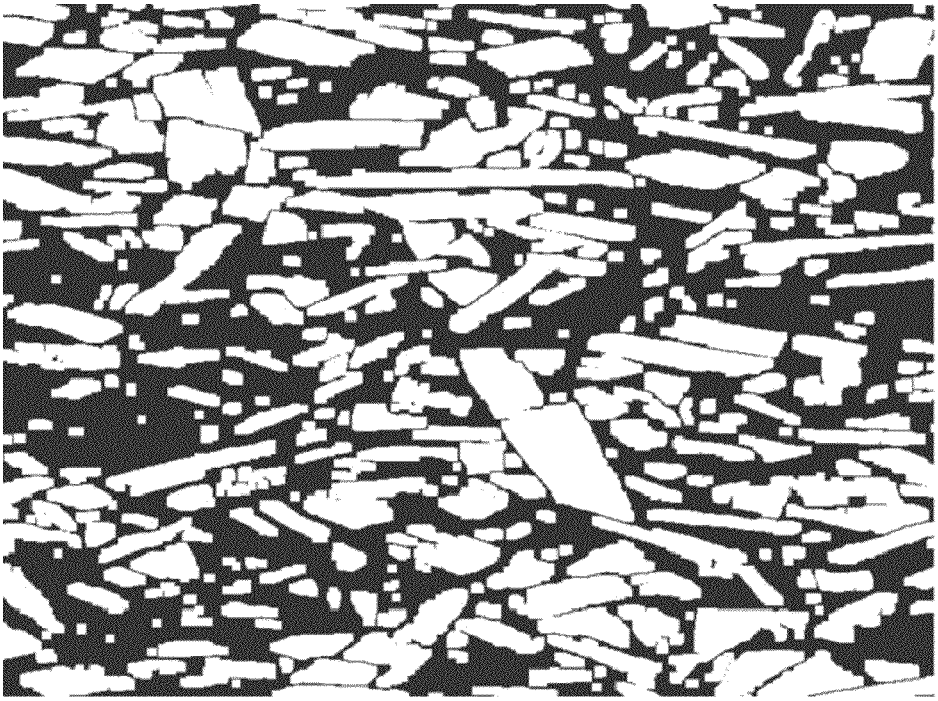
FIG. 15 is a portion of an image obtained with morphological operations of dilatation and erosion from the image portion of FIG. 14.

Morphological operations of dilatation and erosion are followed to eliminate noise, to bind isolated pixels by forming clouds and to promote contour closing, providing an image such as shown in FIG. 15.

Figure 16:
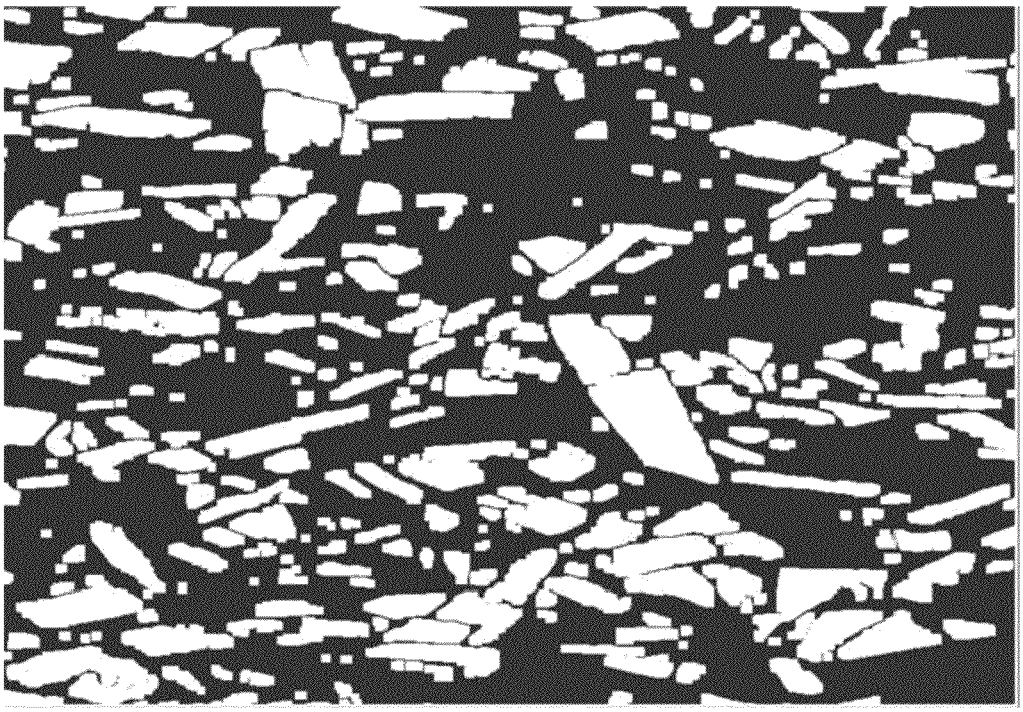
FIG. 16 is a portion of an image obtained through a preselection according to a perimeter/area ratio for regions within the image portion of FIG. 15 to retain for generating statistical data.

From the contours, a pre-selection of regions to retain for statistical data is performed by eliminating the regions whose contour is too long with respect to area (ratio perimeter/area) to belong to a single chip, such as performed on the image shown in FIG. 16.

Figure 17:
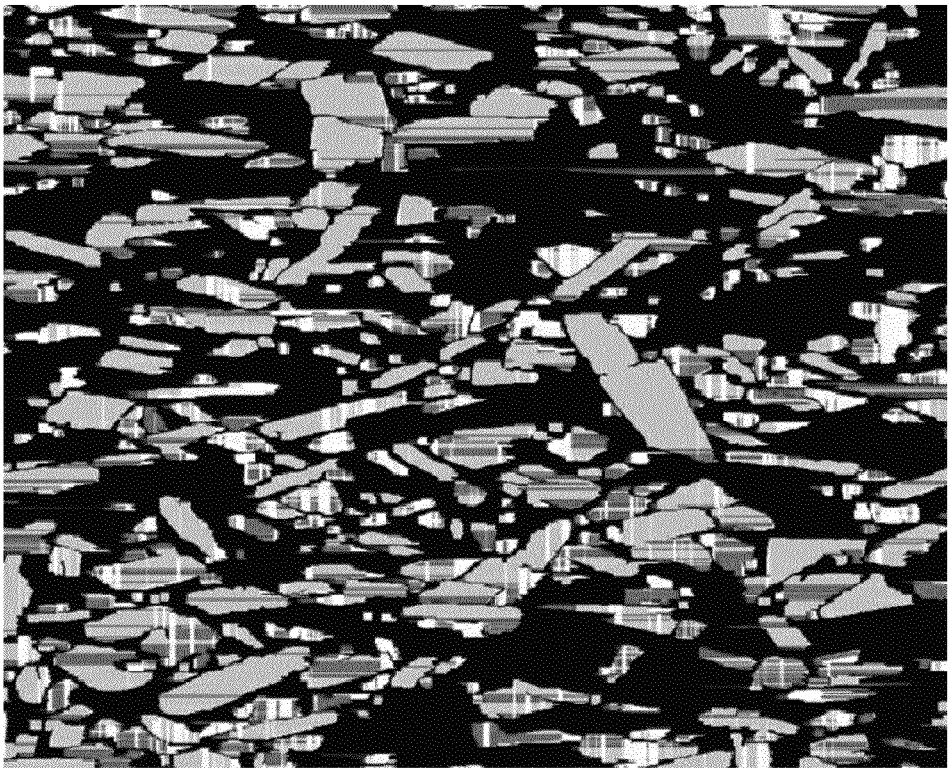
FIG. 17 is a portion of an image produced by filtering of the image portion of FIG. 16 for locating obstruction zones.
Figure 18:
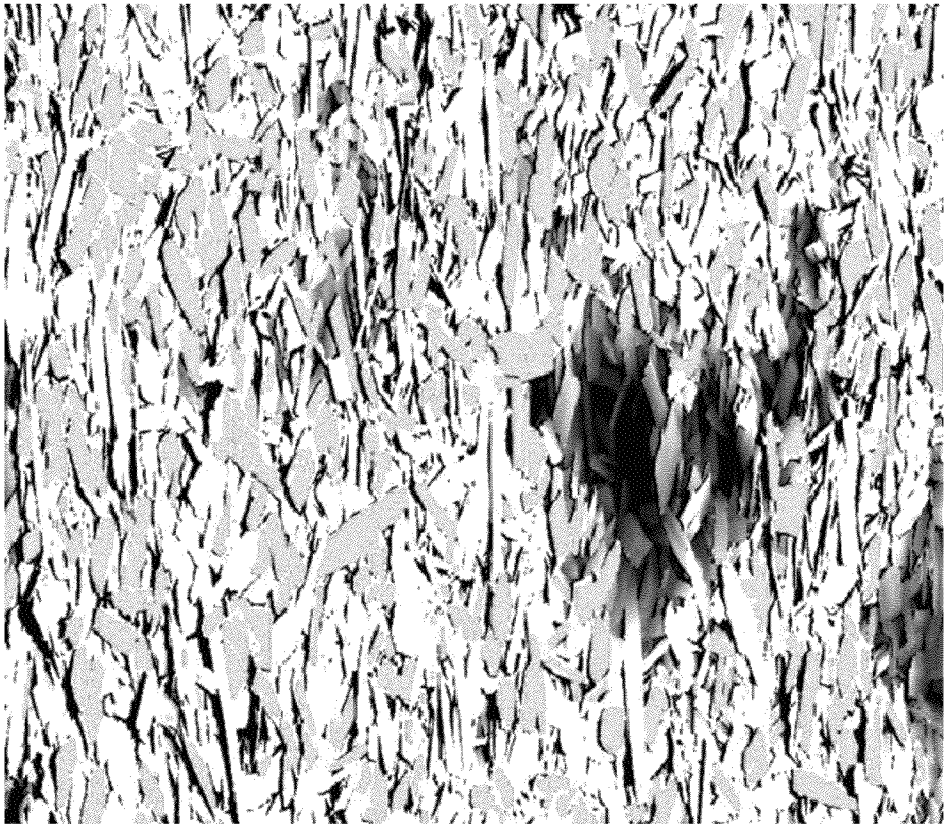
FIG. 18 is a final image resulting from the segmentation step, superimposed to the raw image of FIG. 6.

Then, obstruction zones where a granule covers another are searched by applying a step filter according to lines and columns of the raw image such as shown in FIG. 16. Hence, a processed image such as shown in FIG. 17 is obtained, wherein the columns and lines where an obstruction has been detected are indicated by distinct levels of grey (e.g. columns: pale, lines: dark). Then, the program computes a selection function that is dependent upon the total number of pixels within the region and the obstruction ratio. That function enables the selection of groups of pixels associated with image zones corresponding to distinct granules, by retaining the large granules characterized by a slight obstruction (in percentage of area) while eliminating the granules having a major hidden portion. FIG. 18 is a final image resulting from segmentation step, superimposed on the raw image of FIG. 6 and showing the distinct particles in grey.

As mentioned above, the last step before statistical data compiling consists of computing the geometric correction to consider the surface orientation of the chips. Conveniently, a regression plane is calculated on the basis of points corresponding to each distinct chip in the raw image such as shown in FIG. 6. The correction for area measurement is the arithmetic inverse cosine of the angle between the normal of regression plane and Y axis as represented in FIG. 5.

As also mentioned above, the estimation of distributions from the inspection of granules in bulk may involve bias of a statistical nature. To the extent that the bias function is stationary, compensation thereof is possible to infer the actual distribution from the estimated one. An empirical relation linking a dimensional distribution estimated from the inspection of granules in bulk and the actual dimensional distribution of chips constituting the inspected matter can be obtained through a determination of a square matrix of N×N elements, wherein N is the number of groups used for the distribution. By considering that each group i of the actual distribution contributes according to an amplitude $a_{ji}$ to the group j of the estimated distribution, the following relation is obtained:

$$T_j = \sum_i a_{ji} D_i \quad (1)$$

wherein $T_j$ is a normalized value of estimated distribution for a group j and $D_i$ is the $i^{th}$ normalized value of the actual distribution. For the whole distribution, the following matrix equation is obtained:

$$T=AD \quad (2)$$

Wherein T and D are column-vectors containing the observed distributions and A is the matrix to be determined. Finally, one obtains:

$$D=A^{-1}T \quad (3)$$

Hence, the inversion of matrix A enables to obtain the relation between the distribution estimated from inspection of the granules in bulk and the actual distribution.

The relations between chip properties and refining SEC have been identified and used in a simulation model programmed on a computer in order to predict pulp quality from chip properties and refiner operating conditions. The simulation results have been then used to define a strategy for stabilizing chip mixture density so as to reduce refining SEC by reducing the variability of chip properties, as will be explained later in more detail. The method used to obtain the relations between chip properties and SEC for a given pulp quality consisted of performing chip quality, pulping process and pulp quality evaluations. Chip quality evaluation basically consists of determining chip quality-related properties, which include wood species, basic and bulk densities for each species, chip freshness as indicated by brightness (luminance), moisture content (surface, global) and size distribution. Trials at a pilot plant were carried out in order to find the impacts of the wood chip properties on refining energy.

Figure 19:
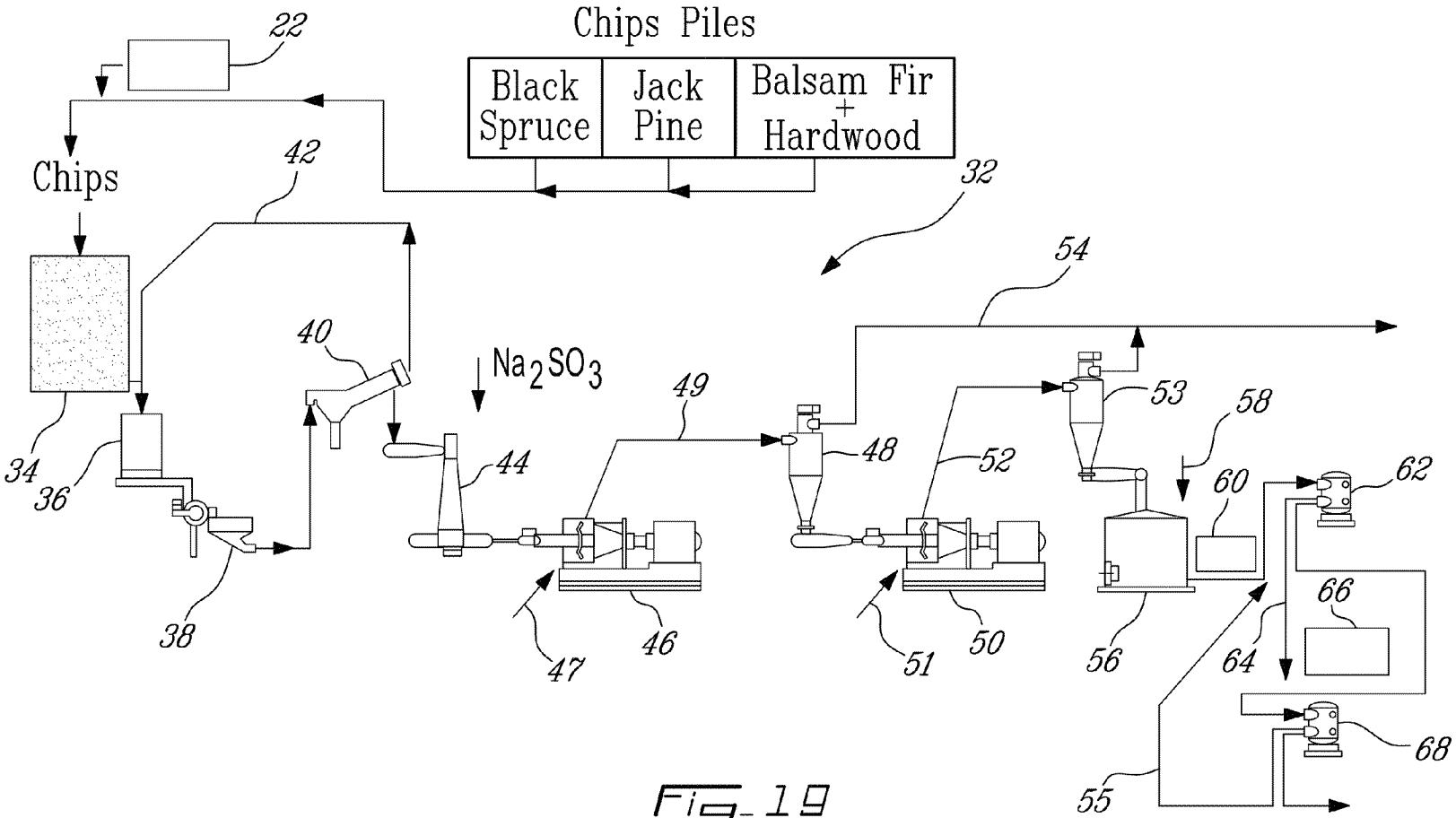
FIG. 19 is a process flow diagram of a typical TMP pulp mill implementing a 2-stage TMP process.

To be applicable to an existing pulping mill process, the operating conditions used in a typical mill has been recreated, namely a 2-stage CTMP (chemi-mechanical TMP) pulping process such as generally designated at 32 in FIG. 19, which includes a chip retention silo 34, followed by a chip pretreatment stage making use of a chip bin 36, washer 38 and plug screw drainer 40 with optional recycling line 42. The process further includes a first refining stage for producing through line 49 partially refined pulp, which makes use of a steaming vessel 44 fed with sulfonation agent such as sodium sulphite ($Na_2SO_3$), a primary refiner 46 with dilution at 47 and a primary cyclone steam separator 48. The process also includes a second refining stage for producing wholly refined pulp through line 52, which makes use of a secondary refiner 50 with dilution at 51, and a secondary cyclone steam separator 53. Primary and secondary refiners may be chosen to operate either at atmospheric or pressurized conditions, and the saturated steam generated by cyclone steam separators 48 and 42 can be evacuated through line 54 for heat recovery. The process further makes use of a latency chest 56 with dilution at 58 for removing latency from refined pulp, and the resulting refined pulp leaving the latency chest 56 can be subjected to quality testing using an appropriate measurement system at 60 such as Pulp Quality Monitor (PQM) available from Metso Automation Canada Ltd (St-Laurent, Quebec, Canada). The process may also include a pulp screening stage including a primary screen 62 at a first outlet 64 of which the accepted pulp may leave and be subjected to further quality testing using an appropriate measurement system at 66 such as Pulp Expert™ also available from Metso Automation Canada Ltd. The screening stage may further include a secondary screen 68 receiving the pulp rejected by primary screen 62 and provided with optional recycling line 55.

The trials have explored different experimental values for chip properties (density, size, etc.) that could not be tried in the context of an actual, continuous mill production. According to some Canadian mills' experiences, variations in percentages of wood species have been proposed in the ranges seen in Table 1.

TABLE 1

| Wood species | % of total mixture |
|---|---|
| Black spruce | 70%-90% |
| Balsam fir | 0%-15% |
| Jack pine | 0%-20% |
| Hardwood | 0%-10% |

So to as reflect mill's actual species ranges, five (5) chip mixtures as described in Table 2 were subjected to pilot trials.

TABLE 2

| Wood species | Mixture 1 (typical) | Mixture 2 | Mixture 3 | Mixture 4 | Mixture 5 |
|---|---|---|---|---|---|
| Black spruce | 80% | 90% | 70% | 75% | 85% |
| Fir | 5% | 10% | 0% | 15% | 5% |
| Pine | 10% | 0% | 20% | 5% | 5% |
| Hardwood | 5% | 0% | 10% | 5% | 5% |

The typical mixture being the most representative of the one used at the considered mill, it reflects the normal operating conditions. Mixtures 2 and 3 were used to verify the influence of maximum and minimum spruce presence, respectively, on energy consumption. Mixtures 4 and 5 provide information on proportions still representative of the typical mixture, but with more or less amounts of fir.

The pilot trials demonstrated the effect of species and density, considering that basic density of each species as well as bulk density of each mixture were different. More particularly, the impact of wood species proportions on SEC to produce a predetermined pulp quality (CSF) was measured.

Previous results showed that moisture content also plays a role in pulp quality, a high proportion of moisture conferring better resistance properties to the resulting paper, as discussed by Eriksen et al. in "Consequences of Chip quality for Process and Pulp Quality in TMP Production", International Conference, Mechanical Pulping, Oslo, June (1981). However, while chip freshness is another important parameter in the TMP process as playing a prominent role in determining bleaching agent consumption, its effect on the refining energy had not been heretofore considered. According to the proposed approach, the impact of chip freshness and moisture content on pulp quality and SEC were determined experimentally. For so doing, chips were dried at two different levels from their natural state. The moisture content variation was in the range of 36%-48% by controlling drying rate. A mixture typical of the normal mill operation was used as described in Table 3, in terms of wood species content and aging measurement data represented by brightness loss.

TABLE 3

| Wood species | Typical mixture | Brightness loss Trial 1 | Brightness loss Trial 2 |
|---|---|---|---|
| Black spruce | 80% | 3 levels | 6 levels |
| Fir | 5% | | |
| Pine | 10% | | |
| Hardwood | 5% | | |

As to size distribution, it was demonstrated that the needed SEC to obtain a pulp of CSF 500 mL decreases proportionally with chip size, as reported by Marton et al. in "Energy Consumption in Thermomechanical Pulping", TAPPI, 64-8, p. 71 (1981). However, chip size has no effect on SEC for pulps refined to CSF values of less than 500 mL. Therefore, smaller chips help decrease SEC but those of lengths lower than 5 mm will produce pulps that have weaker resistance properties. For a fixed SEC, a superior pulp quality (fibre length, adhesion) will be obtained with thickness between 4 and 8 mm, as taught by Hoekstra et al. in "The Effects of Chip Size on Mechanical Pulp Properties and Energy Consumption", International Conference, Mechanical Pulping, Washington, June, 1983, or with lengths between about 16 and 22 mm. The need for SEC increases for a fixed CSF when thickness is higher than 6 mm or when length is about 19 mm. The categories of smallest chips as well as largest ones were refined twice for experimental error verification purposes. The average size distribution of three (3) batches of the typical mixture as used in pilot trials is given in Table 4. For the purposes of trials, the relative content of wood chips of each size category was chosen to form a medium, acceptable size batch and two unacceptable size batches, respectively containing excessive contents of small and large size wood chips, respectively.

TABLE 4

| Width (mm) | Small (%) | Medium (%) | Large (%) |
|---|---|---|---|
| <=5 | 1 | 1 | 1 |
| 5-9 | 24 | 12 | 4 |
| 10-15 | 40 | 30 | 25 |
| 16-28 | 32 | 45 | 65 |
| >29 | 2 | 12 | 5 |

The correlations between the specific chip properties and pulp quality were determined and tested through pilot trials and served to determine optimal operation strategies, on the basis of specific or trend data indicating the most suitable chip properties such as density and size distribution for producing pulp of an acceptable quality while minimizing specific energy consumption. For the purposes of mill validation of optimal control strategies, the CMS and CWS systems along with volume sensor and chip sizing subsystem were installed in the mill, to provide online measurement information allowing to obtain the relations between needs in refining SEC and chip properties, i.e. for a given pulp quality, to establish the impact of chip quality on refining energy. The measurement systems allowed the observation of interactions between mean values obtained at the trials (CSF, SEC, chip properties), and of the variability effect of each of these values (standard-deviation) on the other ones of these values. The determination of relations between chip quality and pulp quality was successful for different proportions of wood species and different chip conditions, so that the found relations were considered reliable.

Figure 20:
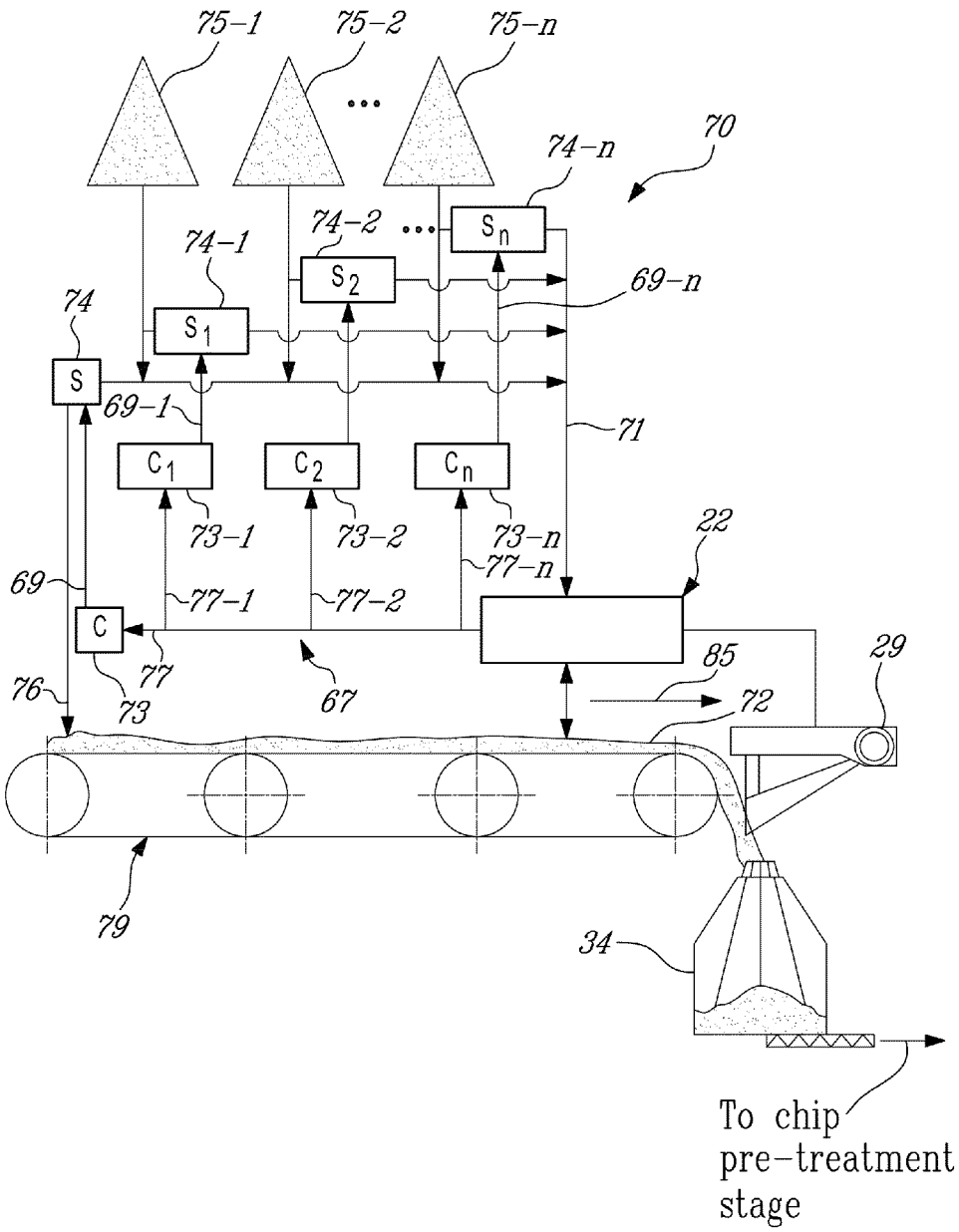
FIG. 20 is a chip pile dosage stage used to stabilize chip quality prior to refining.

In order to first stabilize chip quality, the dry bulk density of the mixtures (dry weight/wet chip volume) is controlled at the chip feeding stage by a chip pile dosage stage generally shown at 70, which includes a matter flow control unit generally designated at 67 that will now be described in view of FIG. 20. Alternatively, another wood chip property such as basic density may be used, depending upon the operator's choice. A way to accomplish this control will be described later in more detail in view of FIGS. 23 to 28. At the process entrance point of the chips 72 on the conveyer 79, the chip quality online measurement system 22 referred to above is provided, for performing measurements of the passing chip mixture's properties (i.e. brightness, darkness, weight and mass flow rate, volume and volume flow rate, densities, moisture content, bark content). Screw speed controllers 73-1 to **73-*n* are assigned to the species chip feeding screws 74-1 to 74-*n* through respective control lines 69-1 to 69-*n*, receiving chips from n corresponding piles 75-1 to 75-*n* in the example shown. A desired set point value for a controlled wood chip property selected by the operator, such as dry bulk density or basic density, is given to the computer unit of measurement system 22, which receives through data line 71 speed measurement values from sensors (not shown) provided on each of screws 74-1 to 74-*n*. In operation, the species proportions are handled by screw speed controllers 73-1 to 73-*n*, using respective set point values through lines 77-1 to 77-*n* to control the speed of each one of the screws, so that a resulting mix of chip from pile 75-1 to pile 75-*n* is discharged on conveyor 79 as indicated by arrow 76 though main discharging screw 74 provided with speed sensor (not shown) and linked through control line 69 to a controller 73 receiving its set point value from the computer unit 23 of measurement system 22 through line 77 on the basis of speed measurement value obtained through data line 71. Whenever the chip mixture property values become unacceptable or exhibit a tendency towards unacceptable values, a selective adjustment of screw speed is performed by the controllers 73, 73-1 to 73-*n* accordingly to stabilize the controlled chip property, thereby providing more or less of the necessary species to the resulting mixture. For example, if too much black spruce is used according to the set point value of this species' needed value, the associated controller (for example 73-1) will react by decreasing corresponding screw speed to bring spruce presence to a normal percentage. For so doing, the feed screw speed set points are adjusted to reverse the unacceptable tendency (ex. too high density) by mixing new mixture proportions. The stabilized flow of chips can then be subjected to size measurement by passing in the direction of arrow 85 through the sensing field of chip sizing subsystem 29 as part of measurement system 22 prior to be discharged to retention silo 34**.

Once the chip quality values were stabilized to a predetermined level according to the relations found at the pilot trials, a prediction of the obtained pulp quality was carried out at the mill. The results of pilot trials and mill trials were then compared, and no significant deviation between the results was observed.

The measurement system 22 described above can be used as a decision support system (DSS) capable of helping operators to minimize the SEC through a predictive control over the refining process. From the measurement results, and simultaneously with the applied feedback control described above, operators can notice chip property predictions and tendencies before the chips reach the retention and preheating retention silos disposed upstream the refining stage. In this way, operators have time to take necessary precautions and make appropriate adjustments on the process parameters (plate gap, dilution flow rate, chip transfer screw speed) to counter any unacceptable tendency exhibited by the chip properties signalled by the measurement systems. In the context of the previously discussed example concerning bulk density, if the measured value for that property is found to be too high, that value is displayed at the operator's refining line monitoring station when the chips have just passed through the measurement systems. Having real-time information on chips density as well on the trend taken by the chips, and knowing that at a future, predetermined time period (for example in 15 minutes), the analysed chips when being refined will have the measured density, the operator is capable of manipulating the process parameters to produce an acceptable quality pulp considering the measured density value.

Figure 2:
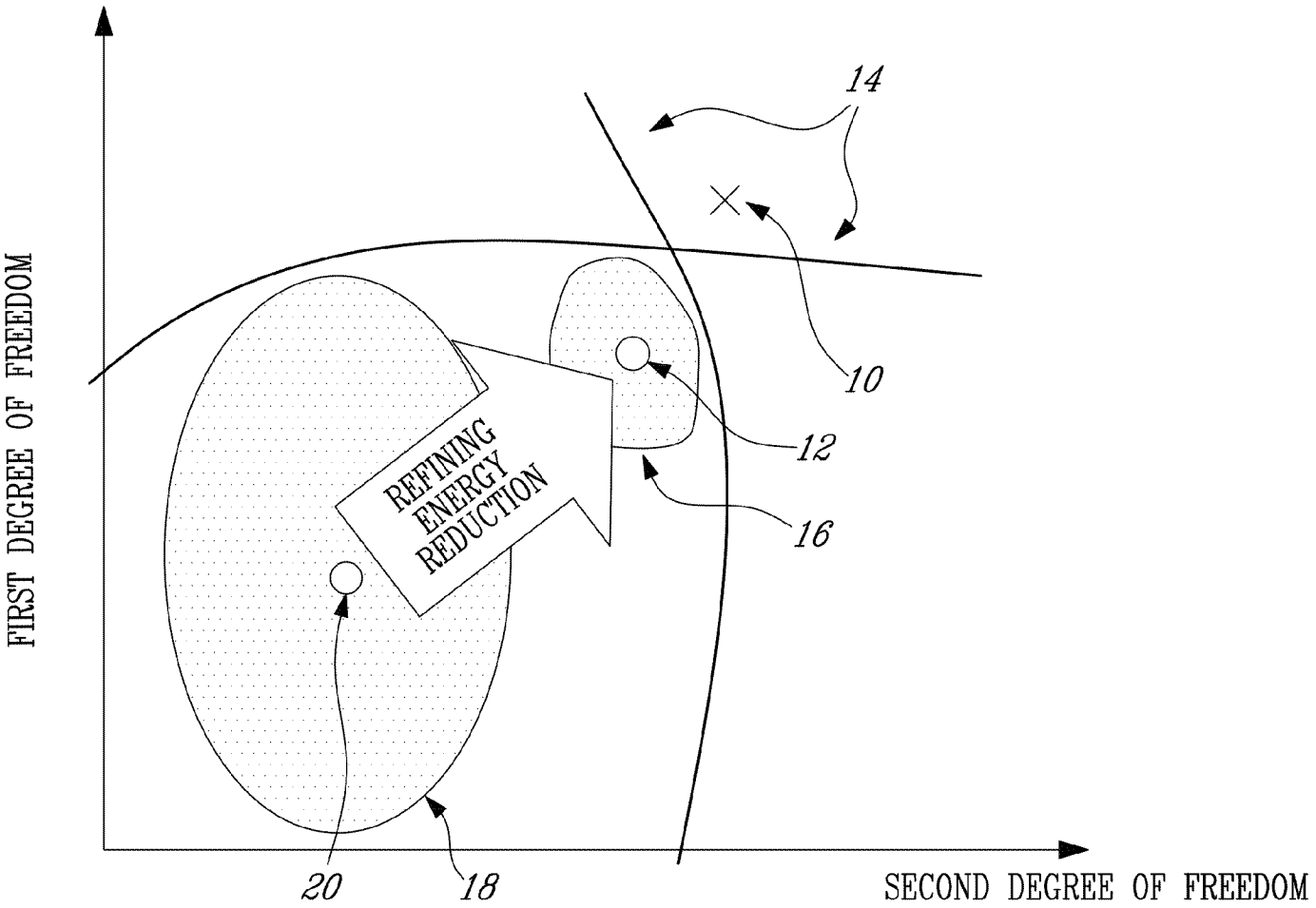
FIG. 2 is a graph showing an example of controllable area delimited by constraints in the context of a refining process involving two degrees of freedom.
Figure 23:
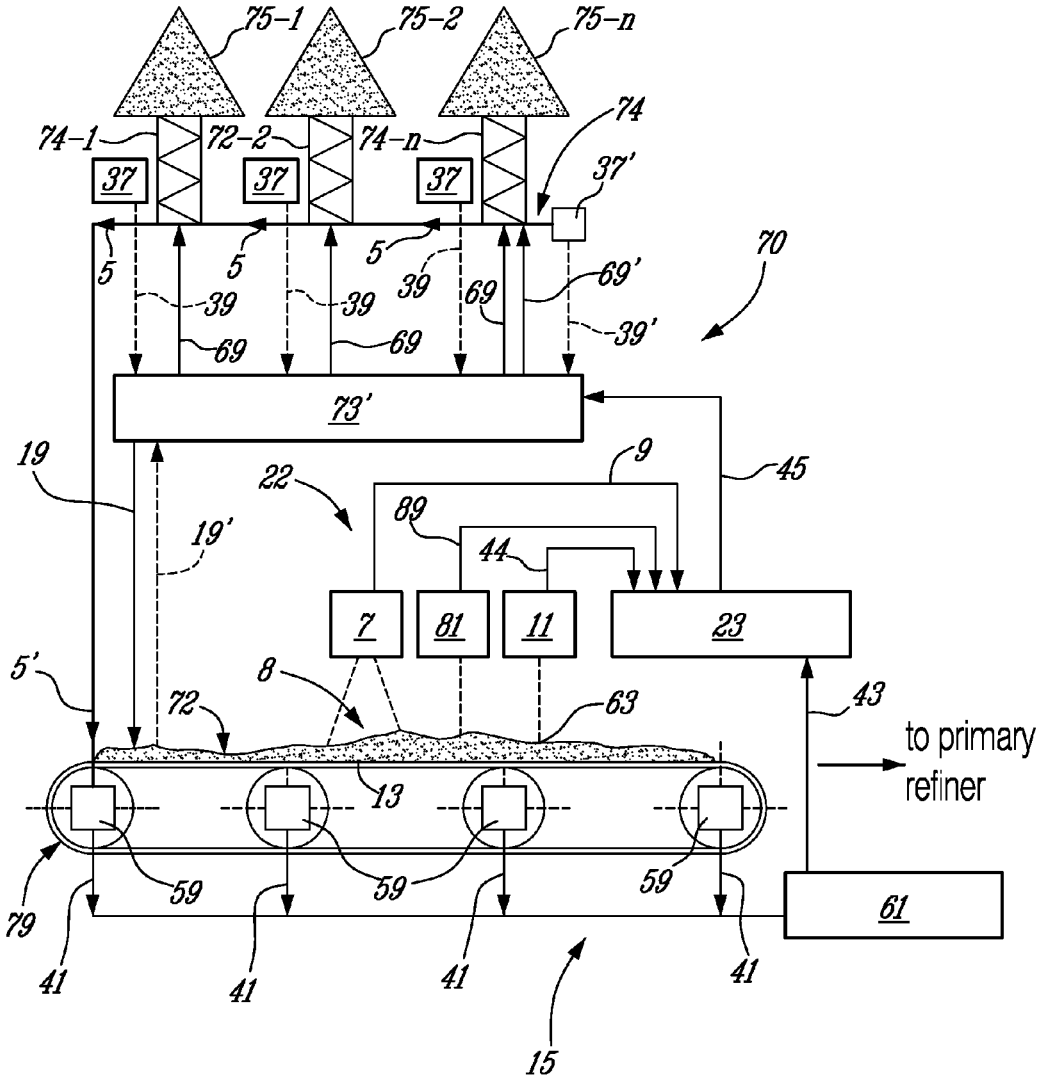
FIG. 23 is a schematic diagram of a system using a computer unit for controlling relative proportion of wood chips originating from a plurality of sources from which a mass of wood chips is formed and conveyed toward the primary refiner used by the pulping process.
Figure 24:
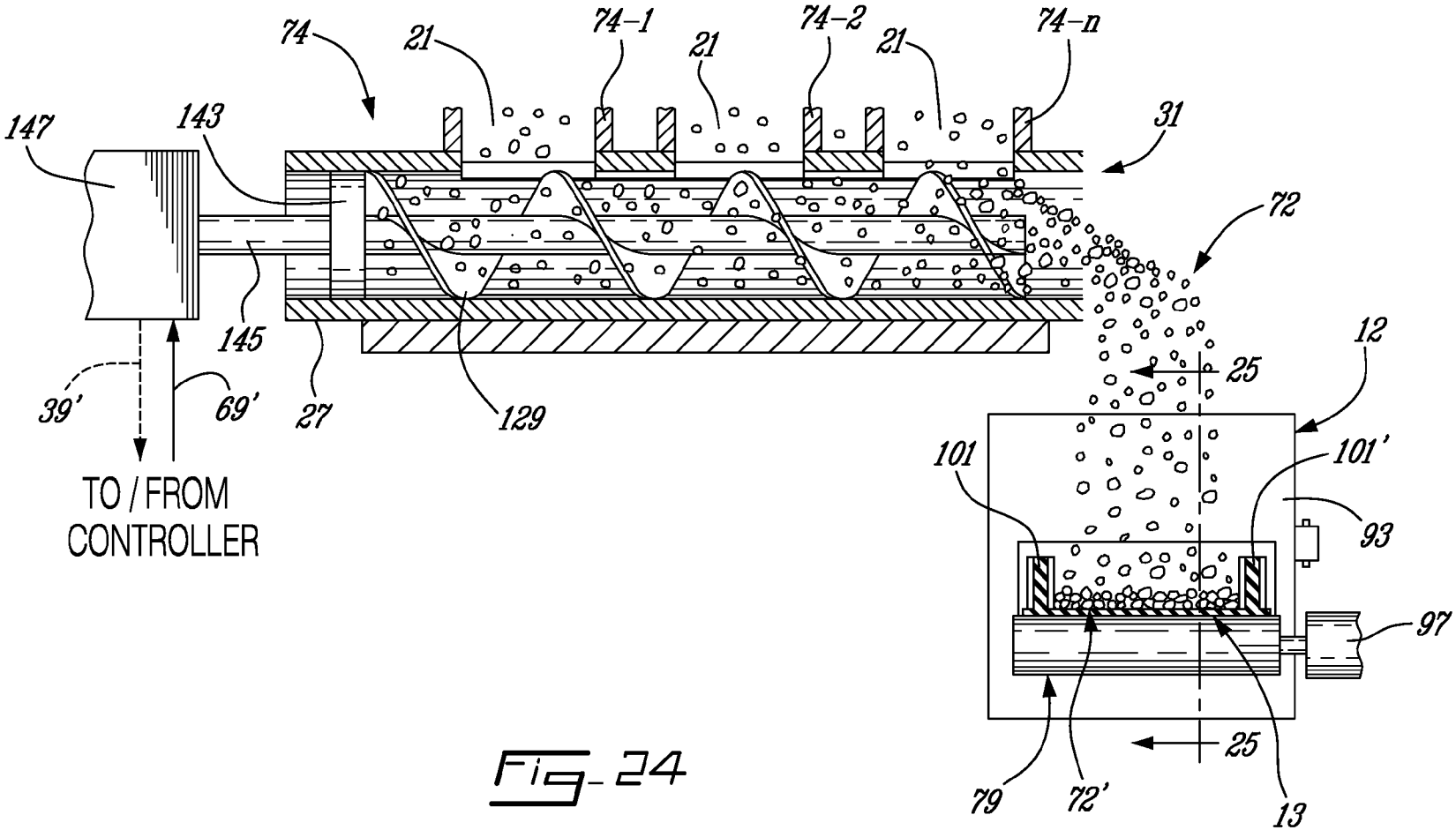
FIG. 24 is a partially cross-sectional end view of a main discharging screw device feeding a conveyor transporting the wood chips through the optical, moisture and volume measurement station that can be used to perform the wood species proportion estimation.

Referring now to FIG. 23, there is generally represented at 70 a chip pile dosage stage for controlling relative proportion of wood chips originating from a plurality of sources of wood chips numbered 75-1 to **75-*n* (n=3 in the example shown), usually in the form of piles of raw wood chips, in communication with means for discharging such as screw devices 74-1, 74-2, 74-*n*, the output of which being received and transported by a main discharging screw device 74 in a direction indicated by arrows 5 on FIG. 1, which screw device will be described in detail with reference to FIG. 24. The main screw discharges the wood chips as indicated by arrow 5' to form a mass of blended wood chips 72 to be fed to a process for producing pulp, which typically makes use of a primary refiner in the case of a TMP process. As will be explained below in detail, the wood chips of each pile may be characterized by either a substantially pure wood species or a mixture of wood species of variable quality, depending upon available chips from providers. The chip pile dosage stage 70 includes a measurement system generally designated at 22 including an optical scanning unit 7 integrating illumination means for directing light onto a scanned area 8 of wood chips 72, and an optical imaging device for sensing light reflected from the illuminated wood chips, to produce through output line 9 image data representing at least one light reflection-related property characterizing the wood chips 72. Although only wood chips forming the top surface of the mass of wood chips 72 are illuminated and sensed, the scanning mode of operation of unit 7 ensures that these illuminated wood chips present light reflection characteristics substantially representative of all wood chips 72. The measurement station further includes a density measuring unit preferably making use of a weighing unit generally designated at 15 for measuring weight of at least a representative portion of the wood chips 72, and of a volume meter 11 for measuring volume of the same portion of wood chips. The weighing device 15 preferably makes use of a plurality of weight sensors such as load cells 59 transversely mounted in pairs along wood chip conveyer 79 and mechanically coupled to the endless belt 13 thereof to be responsive to the weight of wood chips transported by conveyer 79. The weight signals generated by load cells 59 through respective output lines 41 are combined by a weighing acquisition module 61 that produce resulting calibrated and balanced weight data. A weighing device such as Z-Block from BLH Electronics Inc. Canton, Mass., can be used. A load cell is a transducer that converts force into a measurable electrical output. Each load cell included bonded strain gauges, which are positioned so as to measure applied shear stresses. The strain gauges are wired to a Wheatstone bridge circuit which, when crossed with an excitation voltage, produces changes in the electrical output that are proportional to the applied force. Thanks to low deflection, low mass design and the absence of moving parts, such load cells afford excellent high frequency response for dynamic force measurement. Three measurements must be considered for online chip weighing, namely: wood chip weight, speed of belt 13 through line 19' and position of main discharging screw device 74 through line 39'. A check was performed on the precision of the load cells 59. While the conveyer was running, a standard 25-kilogram weight was placed on each load cell 59**. The results are shown in Table 5.

TABLE 5

| Test No. | $W_{Standard}$ (kg) | $W_{Measurement}$ (kg) Minimum | Maximum |
|---|---|---|---|
| 1 | 0 | −0.2 | 0 |
| 2 | 25 | 24.9 | 25.1 |
| 3 | 50 | 49.8 | 50.2 |
| 4 | 75 | 74.9 | 75.1 |
| 5 | 100 | 99.7 | 100.2 |
| 6 | 125 | 124.7 | 125.5 |
| 7 | 150 | 149.2 | 150.0 |
| 8 | 175 | 174.5 | 175.2 |
| 9 | 200 | 199.8 | 200.2 |

It is to be understood that any other suitable weighing device based on a different weight measurement principle may be used.

The volume meter 11 is preferably based on an optical ranging sensor measuring the distance separating the sensor reference plane and a scanned point 63 of the top surface of the mass of wood chips 72, from which the volume can be derived, knowing the distance separating the sensor reference plane and the surface of conveyer belt 13, and also knowing width thereof. On the conveyer, chip morphology or profile can be assumed to be constant due to the use of a proper screw spillway design, thus making it possible to infer chip volume on the basis of the bed height measurement. An infrared analog distance sensor such as model SA1D from IDEC Corporation, Sunnyvale, Calif., can be used. It is to be understood that any other suitable distance ranging device based on a different measurement principle, or any other sensor adapted to direct volume measurement, may be used. Weight and volume measurement data generated through output lines 43 and 44 respectively, are used to derive data representing at least one density-related property characterizing the mass of wood chip 72, and more specifically bulk density, as will be explained later in more detail. The chip pile dosage stage further includes a computer unit 23 whose data processor is programmed with a model characterizing a relation between the wood chip properties and the wood species characteristics of the wood chips of each source or pile 1 to n. The computer unit 23 is further programmed to process output data from measurement station 22 with the model to obtain estimation data representing the wood chips relative proportion. Conveniently, the data processor of computer unit 23 is used to derive the data representing density-related property data on the basis of weight and volume measurement data received from weighing device 15 and volume meter 11. The computer unit 23 is also programmed to compare the estimation data with predetermined target data to produce error data through control output line 45, which data indicate variation in the wood species composition of the wood chips to be processed. The system 1 further includes a controller unit 73' operatively connected to the drive motor (not shown) provided on each discharging screw device 74-1 to **74-*n* through control lines 69 for selectively modifying the discharge rate of one or more of wood chip sources or piles 1 to n, on the basis of the error data received from computer unit 23, to adjust the relative proportion of wood chips species in the mass of wood chips 72 to be processed. The controller unit 73' is also connected to the drive motor of the main discharging screw device through further control line 69', as will be explained below with reference to FIGS. 24 and 25. To obtain better control accuracy over the discharge adjustment, a volumetric sensor 37 is coupled to each screw device 74-1 to 74-*n* to provide through feedback lines 39 a signal indicating of the effective discharge rate as a result of commands received from controller 73'. A similar sensor 37' is coupled to the main discharging screw device to provide feedback signal to controller 73' through line 39'. Conveniently, a conventional encoder mechanically or optically coupled to the driving shaft of each screw device can be used as volumetric sensor. In order to provide a more accurate estimation, the set of wood chip properties considered by the model further includes moisture content, which property is preferably measured by a moisture sensor 81 provided on the measurement station 22, producing through output line 89 data representative of the moisture content of the wood chip 72, which data is processed by computer unit 23** with the model to obtain the estimation of wood chips relative proportion on the basis of species composition. Furthermore, the moisture measurement can be also used to derive an estimation of basic density that may be advantageously used as a further input to the model, as will be later explained in more detail.

As to the weighing function of the system, the disturbance due to the fact that wood chips are falling on the conveyer belt 13 under gravity will now be defined and analysed. As shown on FIG. 24, wood chips 72 fall from a given height of typically about one meter onto belt 13 of conveyer 79. The chip's gravitational potential energy is equal to its weight times the falling distance. It is desirable to model this gravity force in order to make an assessment of a possible source of measurement error. For a given period of time, the chips fall on an area covering about 0.31×1.5 $m^2$ in the present example. Supposing that the average wood chip thickness is 5 mm, fallen chip volume is about:

$$V=0.31\times1.5\times0.005=2.325\times10^{-3}\ (m^3) \quad (4)$$

Assuming an average basic density Σ of wood chip is 450 $kg/m^3$, the fallen chip mass is:

$$m=\rho\times V=450\times2.325\times10^{-3}=1.04625\ (kg) \quad (5)$$

the chip's gravitational potential energy is:

$$E_C=m\times g\times h=1.04625\times9.81\times1=10.26\ (N\cdot m) \quad (6)$$

wherein:

g=acceleration of gravity=9.81 ($m/s^2$)

h=chip falling height (m)

The idler reaction work is:

$$W=F\times L \quad (7)$$

Wherein:

F=idler reaction force (N),

L=conveyer length (m).

According to the energy conservation law, the chip's gravitational potential energy equals the idler reaction work ($E_C$=W). Thus, by transferring values between equations (6) and (7):

$$F=E_C/L=10.2637/17=0.60\ N=61.18\ (g) \quad (8)$$

Taking into account equation (8), the chip gravity force equals idler reaction force F, and is equivalent to 61.18 (g). In practice, this force generally does not really influence measurement accuracy, as the typical analog/digital resolution of instrumentation used is about 9 (g) and its probable analog/digital system absolute error is 300 (g).

A method used by the weighing unit and computer to derive wood chips mass and density measurements will now be explained in view of the following parameters and corresponding definitions:

| | |
|---|---|
| Wet Chip Mass Modified: | $m_m = m_c + C_g \frac{h_{fall}}{L}$ (kg) |
| Chip Unit Length Mass: | $m_l = \frac{m_m}{l_c}$ (kg/m) |
| Belt Feed Forward Length: | $l_f = v_b \times t$ (m) |
| Chip Fall Mass: | $m_d = m_i \times l_f$ (kg) |
| Chip Flow Profile: | $A_s = l_p \times (h_{CMS} - h_C) \times C_{pc}$ ($m^2$) |
| Fall Volume: | $V_d = l_f \times A_s$ ($m^3$) |
| Fall Bulk Density: | $\rho_{bulk_d} = \frac{m_d}{V_d} \times C_{bulk}$ ($kg/m^3$) |
| Fall Basic Density: | $\rho_{basic_d} = \frac{m_{dry_d}}{V_d} \times C_{basic}$ ($kg/m^3$) |
| Dry chip Mass: | $m_{dry_d} = m_d(1 - H_m)$ |

| Measured parameters are: | |
|---|---|
| Belt speed: | $v_b$ (m/s) |
| Chip Covered Length on Belt: | $l_c$ (m) |
| Wet Chip Mass Measured: | $m_c$ (kg) |
| Global Moisture Content: | $H_m$ (%) |
| Height of CMS to Chip Bed: | $h_c$ (m) |

| Exemplary chip feeding configuration parameter values are: | |
|---|---|
| Chip Passage Width: | $l_p = 0.31$ (m) |
| Height of CMS to Belt: | $h_{CMS} = 0.18$ (m) |
| Chip Fall Height: | $h_{fall} = 1$ (m) |
| Gravity Acceleration: | $g = 9.81$ ($m/s^2$) |
| Conveyer Length | $L = 16.7$ (m) |

| Coefficients and exemplary set values are: | |
|---|---|
| Chip Nominal Mass that Hits the Belt: | $C_g = 0$ |
| Chip Flow Profile Correction Coefficient: | $C_{pc} = 1$ |
| Chip Bulk Density Correction Coefficient: | $C_{bulk} = 1$ |
| Chip Basic Density Correction Coefficient: | $C_{basic} = 1$ |

For an online chip weigh measurement, the desired outputs are chip moisture content or weight, dry weight, bulk density and basic density. Online chip volume data being required to calculate chip densities, a distance sensor is used to measure chip bed height as mentioned before. Chip dry mass and bulk and basic density can be calculated by using the factors of chip moisture content, chip volume and the online chip wet mass measurement. For the purpose of experimentation, oversized and undersized chips were screened out before entering the conveyor, thus making it possible to establish a solid correlation between basic density and bulk density.

Assuming that load cell sampling frequency is 1/t, where t is a time interval between two samples. Belt speed is v, and the mass of chips covering the length of the conveyor is l, a variable that will depend on the position of the chip unloading screw. For a given time, k, the chip mass falling onto the belt can be calculated as:

$$m_d(k) = \frac{m_m(k)}{l_c(k)} \times v_b(k) \times t(k) \tag{9}$$

For a given start time $t_0$ to end time $t_{end}$, the total chip mass measured can be expressed as:

$$m_{total} = \sum_{k=t0}^{t_{end}} m_d(k) \text{ where: } k = t_0, t_1, \ldots t_{end} \tag{10}$$

However, the wood chip mass being generally not homogeneously distributed over the belt, an error will appear in the equation (10). This error can be eliminated if the conveyer 79 is empty at the start of sampling time $t_0$, and the main discharging screw device 74 is stopped at end of sampling time $t_{end}$. The measurement will be halted once and there are no longer any chips on the conveyer. As mentioned above, important variables for evaluating chip basic density and wood chip species variation are the values derived from chip wet mass and dry mass measurement. With the measurement station used in the example described above, the accuracy of load cells is better than ±0.5%. Test results are shown on FIG. 28. A validation test was performed in a TMP mill, in which, for a given volume of dry chips corresponding to 299.4 (t), the measurement station used gave a figure of approximately 290.3 (t), a result which reflects the fact that some lost, unrecoverable chips were not accounted for during the feeding stage.

The measurement station 22 is preferably based on the wood chip optical inspection apparatus known as CMS-100 chip management system commercially available from the Assignee Centre de Recherche Industrielle du Quebec (Step-Foy, Quebec, Canada), which has the capability to measure light reflection-related properties, as well as volume and moisture content data. Such wood chip inspection apparatus is basically described in U.S. Pat. No. 6,175,092 B1 issued on Jan. 16, 2001 to the present assignee, and will be now described in more detail in the context of the estimation of wood species proportion in wood chips according to the present invention.

Referring now to FIG. 24, the measurement station 22 shown is capable of generating color image pixel data through an optical inspection technique whereby polychromatic light is directed onto an inspected area of the wood chips, followed by sensing light reflected from the inspected area to generate the color image pixel data representing values of color components within one or more color spaces (RGB, HSL) for pixels forming an image of the inspected area. The measurement station 22 comprises an enclosure 93 through which extends a powered conveyor 79 coupled to a drive motor 97. The conveyor 79 is preferably of a trough type having belt 13 defining a pair of opposed lateral extensible guards 101, 101' of a known design, for keeping the wood chips to be inspected on the conveyor 79. In the embodiment shown on FIG. 24, only respective outlets 21 of screw devices 74-1 to **74-*n* in communication with a main discharging screw device 74 are shown. It can be seen that the main discharging screw device 74 is adapted to receive through outlets 21 wood chips to be blended from corresponding wood chips sources. It is to be understood that the term "wood chips" is intended in the present specification to include other similar wooden materials for use as raw material for a particular pulp and paper process, and that could be advantageously subjected to the methods in accordance with the present invention, such as flakes, shavings, slivers, splinters and shredded wood. The main screw device 74 has an elongated cylindrical sleeve 27 of a circular cross-section adapted to receive for rotation therein a feeding screw 129 of a known construction. The sleeve 27 has lateral input openings in communication with outlet 21 allowing wood chips to reach an input portion of the screw 129. The sleeve 27 further has an output 31 generally disposed over an input end of conveyer 79 to allow substantially uniform discharge of the wood chips 72 on the conveyer belt 13. The feeding screw 129 has a base disk 143 being coupled to the driven end of a driving shaft 145 extending from a drive motor 147 mounted on a support frame (not shown), which motor 147 imparts rotation to the screw 129 at a speed (RPM) in accordance with the value of the control signal coming from controller unit 73' through line 69', in order to modify the discharge rate of screw 129 to a desired target value. The driving control of screw devices 74-1 to 74-*n*** is performed in a similar way.

Figure 25:
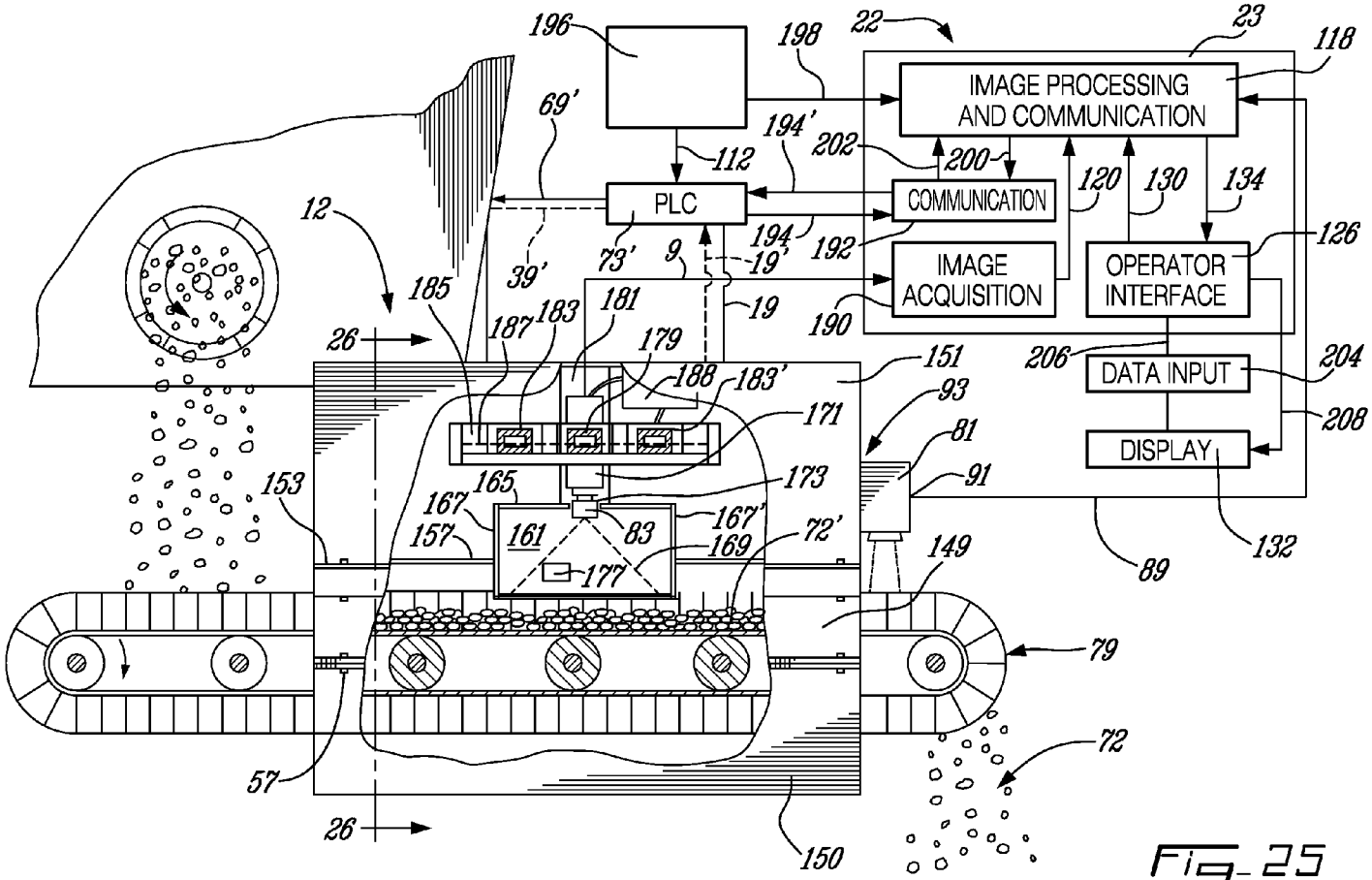
FIG. 25 is a partially cross-sectional side view along section line 25-25 of the measurement station shown on FIG. 24 and being connected to the computer unit of FIG. 23 shown here in a detailed block diagram.
Figure 26:
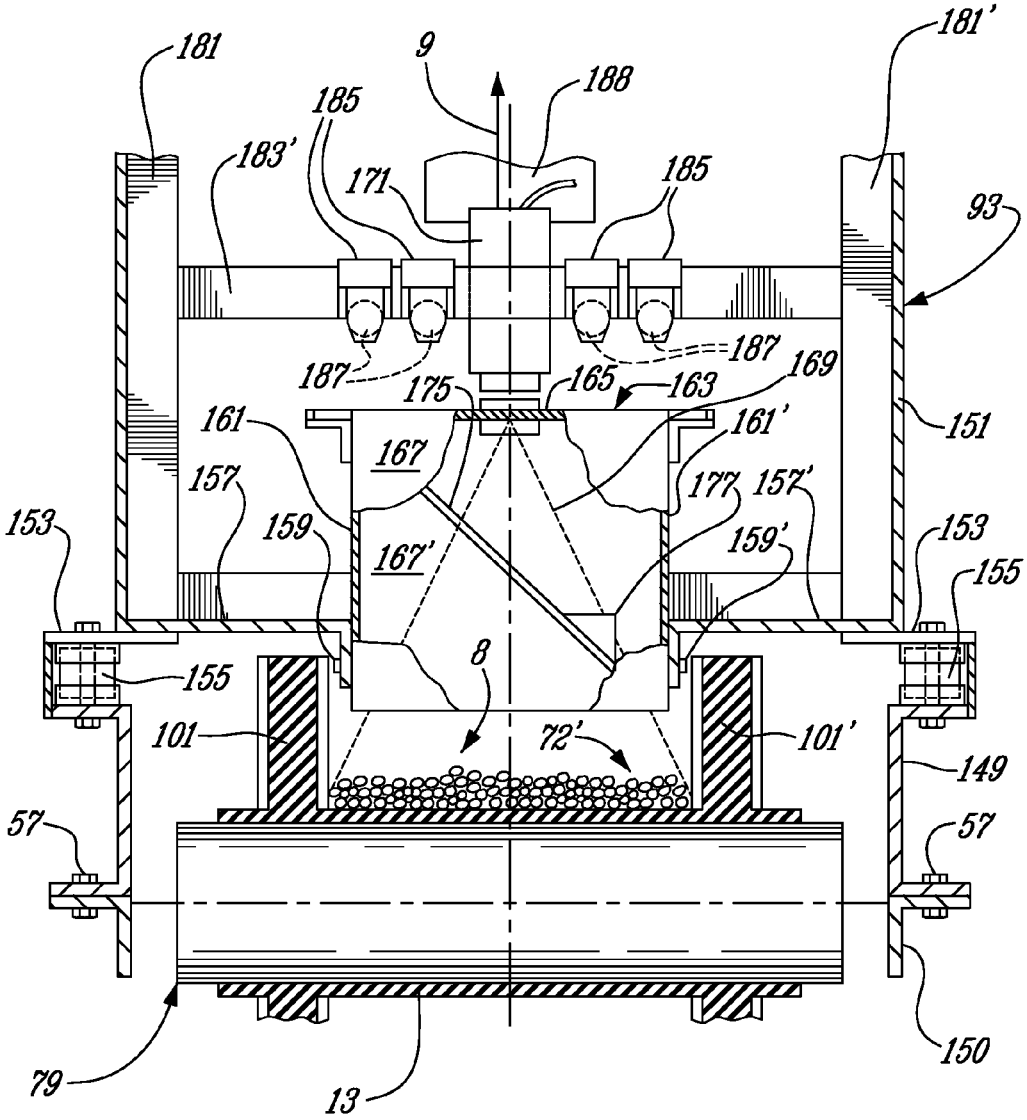
FIG. 26 is a partial cross-sectional end view along section line 26-26 of FIG. 25, showing the internal components of the measurement station.

Turning now to FIGS. 25 and 26, internal components of the measurement station 22 and particularly of the optical scanning unit 7 as shown on FIG. 23 will be now described. The enclosure 93 is formed of a lower part 149 for containing the conveyor 79 and being rigidly secured to a base 150 with bolt assemblies 57, and an upper part 151 for containing the optical components of the station 22 and being removably disposed on supporting flanges 153 rigidly secured to upper edge of the lower part 149 with bolted profile assemblies 155. At the folded ends of a pair of opposed inwardly extending flanged portions 157 and 157' of the upper part are secured through bolts 159 and 159' side walls 161 and 161' of a shield 163 further having top 165, front wall 167 and rear wall 167' to optically isolate the field of view 169 of a camera 171 for optically covering superficial wood chips 72' that are disposed within scanned area 8 as shown in FIGS. 23 and 26, these superficial wood chips 72' being considered as representative of the characteristics of substantially all wood chips 72. The camera 171 is located over the shield 163 and has an objective downwardly extending through an opening 173 provided on the shield top 165, as better shown on FIG. 25. Ideally, the distance separating camera objective 83 and superficial wood chips 72' should be kept substantially constant by controlling the input flow of matter, in order to prevent scale variations that could adversely affect the optical properties measurements. However, the selective discharge adjustment that can be applied to one or more of wood chips sources 1 to n according to the wood species proportion controlling method of the invention does not generally allow a constant input flow through the measurement station 22. Therefore, the camera 171 is preferably provided with an auto-focus feature as well known in the art, and with a distance measuring feature to normalize the captured image data to compensate variation in the inspected area due to variation of the distance separating the camera reference plane and the superficial wood chips 72' within scanned area 8 as shown in FIGS. 23 and 26. The camera 171 is used to sense light reflected on superficial wood chips 72' to produce electrical signals representing reflection intensity values. A 2D CCD matrix, color RGB-HSL video camera such as Hitachi model no. HVC20 is used to generate the color pixel data as main optical properties considered by the method of the invention. While a 2D matrix camera is advantageously used to cover a 2D scanning area 8, it is to be understood that a suitable linear camera can alternatively be used by adapting the measurement station according to corresponding scanning parameters. Turning again to FIG. 26, diagonally disposed within shield 163 is a transparent glass sheet 175 acting as a support for a calibrating reference support 177, whose function will be explained later in more detail. As shown on FIG. 25, the camera 171 is secured according to an appropriate vertical alignment on a central transverse member 179 supported at opposed end thereof to a pair of opposed vertical frame members 181 and 181L secured at lower ends thereof on flanged portions 157 and 157' as shown on FIG. 4. Also supported on the vertical frame members 181 and 181' are front and rear transverse members 183 and 183'. Transverse members 179, 183 and 183' are adapted to receive elongate electrical light units 185 used as illumination means, including standard fluorescent tubes 187 in the example shown, to direct light substantially evenly onto the inspected batch portion of superficial wood chips 72'. The camera 171 and light units 185 are powered via a dual output electrical power supply unit 188. Electrical image data are generated by the camera 171 through output line 9. The camera 171 is used to sense light reflected on superficial chips 72' to generate color image pixel data representing values of color components within RGB color space, for pixels forming an image of the inspected area, which color components are preferably transformed into color components within standard LHS color space, as will be explained later in more detail. When used in cold environment, the enclosure 93 is preferably provided with a heating unit (not shown) to maintain the inner temperature at a level ensuring normal operation of the camera 171. The measurement station 22 may be also provided with air condition sensors for measuring air temperature, velocity, relative humidity, which measurement may be used to stabilize operation of the measurement station.

Referring to FIG. 25, a moisture sensor 81 is shown which is preferably part of the measurement station 22. The sensor 81 is used measure variations in the chip surface moisture content. As will be explained later in detail, the chip moisture content that can be derived from such measurement is an important property that may be advantageously considered as an input variable of the model, and that can be used to derive basic density of wood chips from bulk density measurement. The moisture sensor 81 is preferably a non-contact sensing device such as near-infrared sensor MM710 supplied by NDC Infrared Engineering, Irwindale Calif. The sensor 81 generates at an output 91 thereof electrical signals representing mean surface moisture values for the superficial wood chips 72'.

Control and processing elements of the measurement station 22 will be now described with reference to FIG. 25. The computer unit 23 used as a data processor, which has an image acquisition module 190 coupled to line 9 for receiving color image pixel signals from camera 171, which module 190 could be any image data acquisition electronic board having capability to receive and process standard image signals such as model Meteor-2™ from Matrox Electronic Systems Ltd (Canada) or an other equivalent image data acquisition board currently available in the marketplace. The computer 23 is provided with an external communication unit 192 being coupled for bi-directional communication through lines 194 and 194' to controller unit 73', which is a conventional programmable logic controller (PLC) programmed for controlling operation of each discharge screw device 74-1 to **74-*n* through control line 69' and feedback line 39', as well as conveyor drive 97 through line 19 and feedback line 19' coupled to the drive mechanism of the conveyer 79 to provide a signal indicating of the effective conveyer belt speed. The PLC 73' may receive from line 112 wood chips source data entered via an input device 196 by an operator in charge of raw wood chips management operations, such as wood chips species information. The input device 196 is connected through a further line 198 to an image processing and communication software module 118 outputting control data for PLC through line 200 while receiving acquired image data and PLC data through lines 120 and 202, respectively. The image processing and communication module 118 receives input data from a computer data input device 204, such as a computer keyboard, through an operator interface software module 126 and lines 206 and 130, while generating image output data toward a display device 132 through operator interface module 126 and lines 134 and 208. Module 118 also receives the moisture indicating electrical signals through a line 89**.

Figure 27:
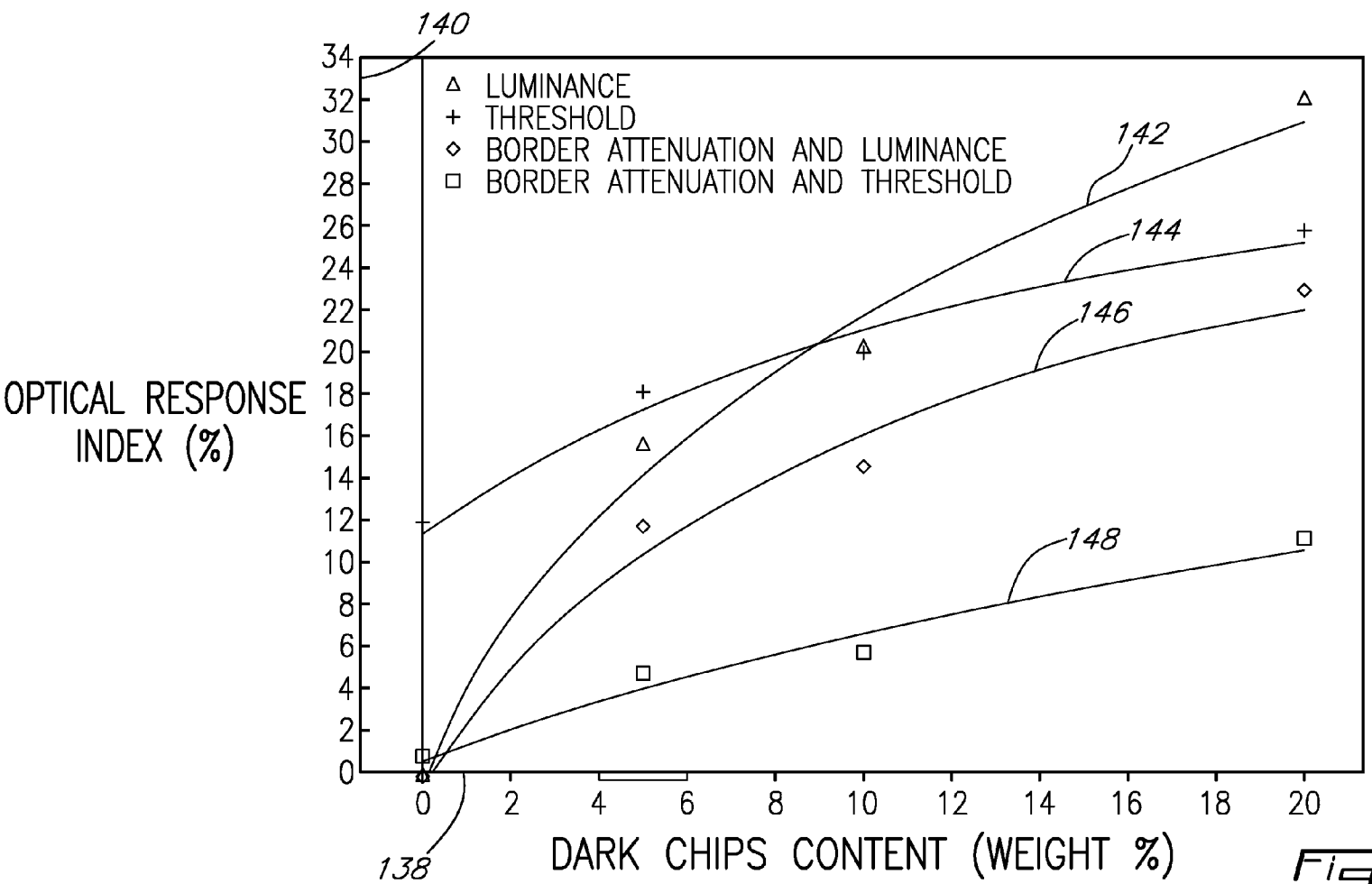
FIG. 27 is a graph showing a set of curves representing general relations between measured optical characteristics and dark wood chips content associated with several samples.
Figure 28:
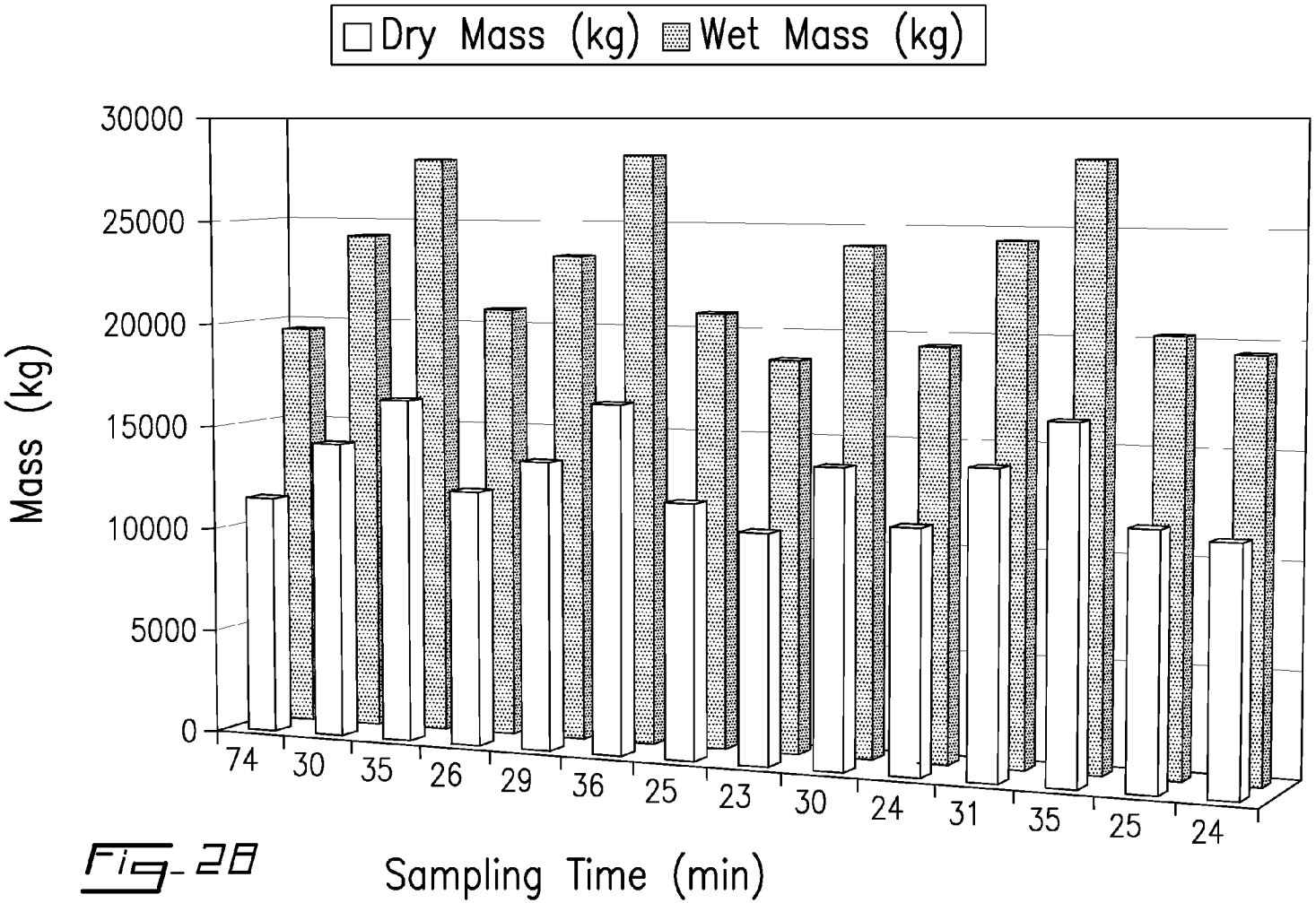
FIG. 28 is a bar graph showing the results of online measurement of the mass of wood chips fed to the measurement station.

Turning now to FIG. 27 general relations between measured optical characteristics and dark wood chips content associated with several samples are illustrated by the curves traced on the graph shown, whose first axis 138 represents dark chips content by weight percentage characterizing the sample, and whose second axis 140 represents corresponding optical response index measured. In the example shown, four curves 142, 144, 146, and 148 have been fitted on the basis of average optical response measurements for four (4) groups of wood chips samples prepared to respectively present four (4) distinct dark chips contents by weight percentage, namely 0% (reference group), 5%, 10% and 20%. Measurements were made using a RGB color camera coupled to an image acquisition module connected with a computer, as described before. To obtain curves 142 and 146, luminance signal values derived from the RGB signals corresponding to all considered pixels were used to derive an optical response index which is indicative of the relative optical reflection characteristic of each sample. As to curve 142, mean optical response index was obtained according to the following ratio:

$$I = \frac{L_R}{L_S} - 1 \tag{11}$$

Wherein I is the optical response index, $L_R$ is a mean luminance value associated with the reference samples and $L_S$ is a mean luminance value based on all considered pixels associated with a given sample. Curve 146 was obtained through computer image processing to attenuate chip border shaded area which may not be representative of actual optical characteristics of the whole chip surface. To obtain curves 144 and 148, reflection intensity of red component of RGB signal was compared to a predetermined threshold to derive a chip darkness index according the following relation:

$$D = \frac{P_D}{P_T} \tag{12}$$

Wherein D is the chip darkness index, $P_D$ is the number of pixels whose associated red component intensity is found to be lower than the predetermined threshold ratio (therefore indicating a dark pixel) and $P_T$ is the total number of pixels considered. As for curve 146, curve 148 was obtained through computer image processing to attenuate chip border shaded areas. It can be seen from all curves 142, 144, 146, and 148 that the chip darkness index grows as dark chip content increases. Although curve 148 shows the best linear relationship, experience has shown that all of the above described calculation methods for the optical response index can be applied, provided reference reflection intensity data are properly determined, as will be explained later in more detail.

Returning now to FIGS. 24, 25 and 27, a preferred operation mode of the chip optical properties inspecting function of the measurement station 22 will be now explained. Referring to FIG. 25, before starting operation, the station 22 must be initialized through the operator interface module 126 by firstly setting system configuration. Camera related parameters can be then set through the image processing and communication module 118, according to the camera specifications. The initialization is completed by camera and image processing calibration through the operator interface module 126.

System configuration provides initialization of parameters such as data storage allocation, image data rates, communication between computer unit 23 and PLC 73', data file management, and wood species information. As to data storage allocation, images and related data can be selectively stored on a local memory support or any shared memory device available on a network to which the computer unit 23 is connected. Directory structure is provided for software modules and system status message file. Image rate data configuration allows to select total number of acquired images for each batch, number of images to be stored amongst the acquired images and acquisition rate, i.e. period of time between acquisition of two successive images which is typically of about 5 sec. for a conveying velocity of about 10 feet/min. Therefore, to limit computer memory requirements, while a high number of images can be acquired for statistical purposes, only a part of these images need to be stored, and most of images are deleted after a predetermined period of time. The PLC configuration relates to parameters governing communication between computer unit 23 and PLC 73', such as master-slave protocol setting (ex. DDE), memory addresses associated with <<heart beat>> for indication of system interruption, <<heart beat>> rate and wood chips presence monitoring rate. Data file management configuration relates to parameters regarding wood chips Input data, statistical data for inspected wood chips, data keeping period before deletion and data keeping checking rate. Statistical data file can typically contain information relating to source or batch number, supplier contract number, wood species identification (pure/mixture), mean intensity values for RGB signals, mean luminance L, mean H (hue) and mean S (saturation), darkness index D and date of acquisition. Data being systematically updated on a cumulative basis, the statistical data file can be either deleted or recorded as desired by the operator to allow acquisition of new data. Once the camera 171 is being configured as specified, calibration of the camera and the image processing module can be carried out by the operator through the operator interface, to ensure substantially stable light reflection intensities measurements as a function of time even with undesired lightning variation due to temperature variation and/or light source aging, and to account for spatial irregularities inherent to CCD's forming the camera sensors. Calibration procedure first consists of acquiring <<dark>> image signals while obstructing with a cap the objective of the camera 171 for the purpose of providing offset calibration (L=0), and acquiring <<lighting>> image signals with a gray target presenting uniform reflection characteristics being disposed within the inspecting area on the conveyer belt 13 for the purpose of providing spatial calibration. Calibration procedure then follows by acquiring image signals with an absolute reference color target, such as a color chart supplied by Macbeth Inc., to permanently obtain a same measured intensity for substantially identically colored wood chips, while providing appropriate RGB balance for reliable color reproduction. Initial calibration ends with acquiring image signals with a relative reference color target permanently disposed on the calibrating reference support 177, to provide an initial calibration setting which account for current optical condition under which the camera 171 is required to operate. Such initial calibration setting will be used to perform calibration update during operation, as will be later explained in more detail.

Initialization procedure being completed, the measurement station 22 is ready to operate, the computer unit 23 being in permanent communication with the PLC 73' to monitor the operation of screw drive 147 indicating discharge of wood chips blend from the sources. Whenever a new batch is detected, the following sequence of steps are performed: 1) end of PLC monitoring; 2) source or batch data file reading (species of wood chips, source or batch identification number); 3) image acquisition and processing for wood species proportion estimation; and 4) data and image recording after processing. Image acquisition consists in sensing light reflected on the superficial wood chips 72' included in a currently inspected batch portion to generate color image pixel data representing values of color components within RGB color space for pixels forming an image of the inspected area 8 defined by camera field of view 169. Although a single batch portion of superficial chips covered by camera field of view 169 may be considered to be representative of optical characteristics of a substantially homogeneous batch, wood chips batches being known to be generally heterogeneous, it is preferable to consider a plurality of batch portions by acquiring a plurality of corresponding image frames of electrical pixel signals. In that case, image acquisition step is repeatedly performed as the superficial wood chips of batch portions are successively transported through the inspection area defined by the camera field of view 169. Calibration updating of the acquired pixel signals is performed considering pixel signals corresponding to the relative reference target as compared with the initial calibration setting, to account for any change affecting current optical condition. Superficial wood chips 72' are also scanned by infrared beam generated by the sensor 81, which analyzes reflected radiation to generate the chip surface moisture indication signals. It is to be understood that while the moisture sensor 81 is disposed at the output of the measurement station 22 in the illustrated embodiment, other locations downstream or upstream to the measurement station 22 may be suitable.

As to image processing, the image processing and communication unit 118 is used to derive the luminance-related data, preferably by averaging luminance-related image pixel data as basically expressed as a standard function of RGB color components as follows:

$$L=0.2125R+0.7154G+0.0721B \tag{13}$$

Values of H (hue) and S (saturation) are derived from RGB data according to the same well known standard, hue being a pure color measure, and saturation indicating how much the color deviates from its pure form, whereby an unsaturated color is a shade of gray. As mentioned before, the unit 118 derives global reflection intensity data for the inspected batch portions designated before as optical response index with reference to FIG. 27, from the acquired image data. For example, experience has shown that spruce and balsam fir are brighter than jack pine and hardwood, and chip ageing and bark content decrease chip brightness. Calibration updating of the acquired pixel signals is performed considering pixels signals corresponding to the relative reference target as compared with the initial calibration setting, to account for any change affecting current optical condition. Then, image noise due to chip border shaded areas, snow and/or ice and visible belt areas are preferably filtered out of the image signals using known image processing techniques. From the signals generated by moisture sensor 81, the image processing and communication unit 118 applies compensation to the acquired pixel signals using the corresponding moisture indicating electrical signals.

Global reflection intensity data may then be derived by averaging reflection intensity values represented by either all or representative ones of the acquired pixel signals for the batch portions considered, to obtain mean reflection intensity data. Alternately, the global reflection intensity data may be derived by computing a ratio between the number of pixel signals representing reflection intensity values above a predetermined threshold value and the total number of pixel signals considered. Any other appropriate derivation method obvious to a person skilled in the art could be used to obtain the global reflection intensity data from the acquired signals. Optionally, the global reflection intensity data may include standard deviation data, obtained through well known statistical methods, variation of which may be monitored to detect any abnormal heterogeneity associated with an inspected batch.

In operation, the computer unit 23 continuously sends a normal status signal in the form of a <<heart beat>> to the PLC through line 194'. The computer unit 23 also permanently monitors system operation in order to detect any software and/or hardware based error that could arise to command inspection interruption accordingly. The image processing and communication module 118 performs system status monitoring functions such as automatic interruption conditions, communication with PLC, batch image data file management and monitoring status. These functions result in messages generation addressed to the operator through display 132 whenever appropriate action of the operator is required. For automatic interruption conditions, such a message may indicate that video (imaging) memory initialization failed, an illumination problem arose or a problem occurred with the camera 171 or the acquisition card. For PLC communication, the message may indicate a failure to establish communication with PLC 73', a faulty communication interruption, communication of a <<heart beat>> to the PLC 73', starting or interruption of the <<heart beat>>. As to batch data files management, the message may set forth that acquisition initialization failed, memory storing of image or data failed, a file transfer error occurred, monitoring of recording is being started or ended. Finally, general operation status information is given to the operator through messages indicating that the apparatus is ready to operate, acquisition has started, acquisition is in progress and image acquisition is completed.

Figure 21A:
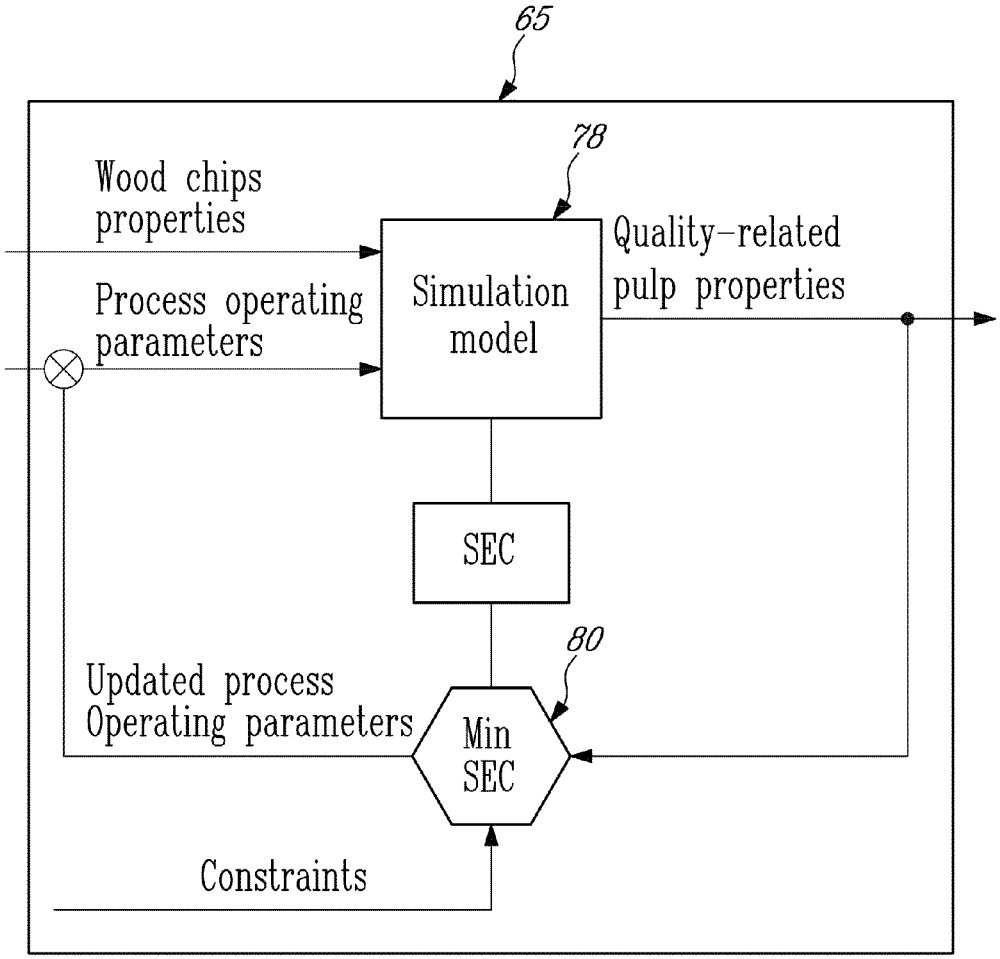
FIG. 21*a* is a schematic block diagram of basic SEC optimization structure for use with a simulation model of a refining process.

The mill was then modeled for pulp quality prediction and refining process optimization purposes, on the basis of the properties of chips entering the primary refiner, considering some refining process input operating parameters such as matter transfer screw speed, dilution flow rate, hydraulic pressure or plate gaps, and retention time delays. For so doing, the simulation software CADSIM Plus™ from Aurel Systems Inc. (Burnaby, BC, Canada) was used. Any other appropriate simulation tool such as the Simulink™ from Mathworks (Natick Mass.) could have alternatively been used. Referring now to FIG. 21*a*, a basic SEC optimization structure for use with a simulation model 78 of a lignocellulosic granular matter refining process programmed on the data processor of computer 65 is shown. The simulation model 78 is based on the above-mentioned relations involving a plurality of matter properties (i.e. moisture content, density-related properties, light reflection-related properties, granular matter size) characterizing the granular matter to be fed to the process, the refining process input operating parameters and at least one refining process output parameter (e.g. CSF, primary motor load, SEC, energy split, long fiber, fines and shives contents). Conveniently, the simulation model is a static model built with an appropriate modelling platform (e.g. neural network, multivariate linear model, static gain matrix, fuzzy logic model). The simulation model 78 is optimized according to a condition of minimum refining specific energy consumption (SEC) and to one or more predetermined process constraints related to one or more of the matter properties, refining process input operating parameters and refining process output parameters, to obtain an optimized refining process model. Fore example, the optimization structure may involve the application of constraints on the quality-related pulp properties such as CSF (ex: $CSF_{min}<CSF<CSF_{max}$), long fiber, fines and shives contents. According to the initial chip properties and refining process input operating parameters, the simulation model 78 finds, through iterations at 80, updated parameter values providing the lowest specific energy while satisfying the specified constraints.

Figure 21B:
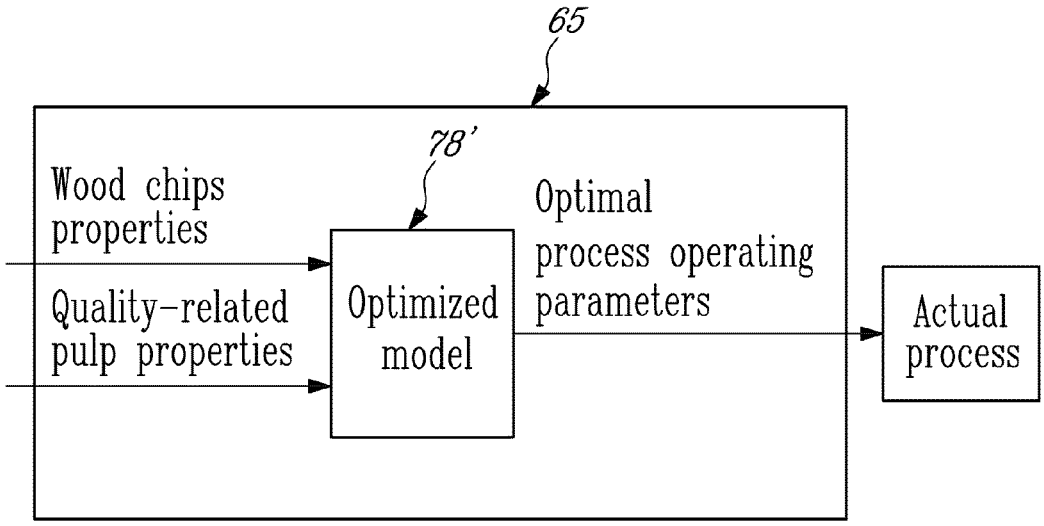
FIG. 21*b* is a schematic block diagram showing the basic optimized simulation model used to operate an actual refining process in open-loop control configuration.

In practice, as shown in FIG. 21*b*, provided with optimal input operating parameters for the refining process, the computer 65 implementing a part or the whole of optimized simulation model 78' can be used in a system for operating an actual refining process in an open-loop control configuration. This involves a consideration of the impact of chip properties and optimal process operating parameters with respect to refining energy and subject to desired pulp quality constraints. The optimized refining process model 78' is fed with data representing measured values of matter properties and data representing a target for the refining process output parameter (such as quality-related pulp properties) to estimate an optimal value of at least one of the input process operating parameters. The estimated optimal operating parameters are manipulated by means of the controllers used by the actual process.

Figure 21C:
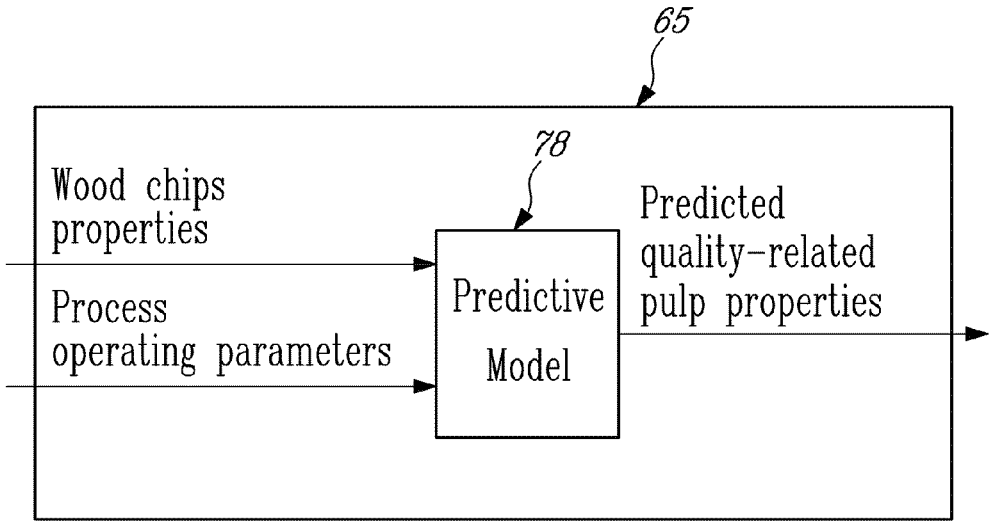
FIG. 21*c* is a schematic block diagram showing the basic simulation model used in a predictive way to estimate quality-related pulp properties.

Referring now to FIG. 21*c*, it can be seen that the computer 65 implementing a part or the whole of the simulation model 78 can also be used in a system for predicting a value of at least one refining process output parameter (such as quality-related pulp properties) using data representing matter properties and actual input operating parameters as measured.

As mentioned above in view of the graph of FIG. 2, the optimization of the refining process involves a displacement of the operating conditions from a current or nominal operation point to a selected, more optimal operating point. However, this displacement must take into account the manoeuvring margin provided by the refiner control system in order to ensure operating stability in presence of external disturbances. In the particular case of the TMP process, optimization of the refining energy consumption depends on chip properties (external disturbances), on the control system used, as well as on constraints inherent to process design (e.g. transfer screw speed, maximum hydraulic pressures on refiner plates, etc.). By definition, a degree of freedom is a process parameter apt to be freely manipulated. Hence, in a general optimization context, the available degrees of freedom are adjusted so as to either maximize or minimize a parameter of an economic nature. The TMP refining process typically involves a limited number of available degrees of freedom to perform energetic optimization since most of manipulable parameters are already used by the mill control system. The available, optimized degrees of freedom allow to traverse the control system limitations when facing with non-linearity of the refining process and seasonal disturbances affecting it.

Figure 22:
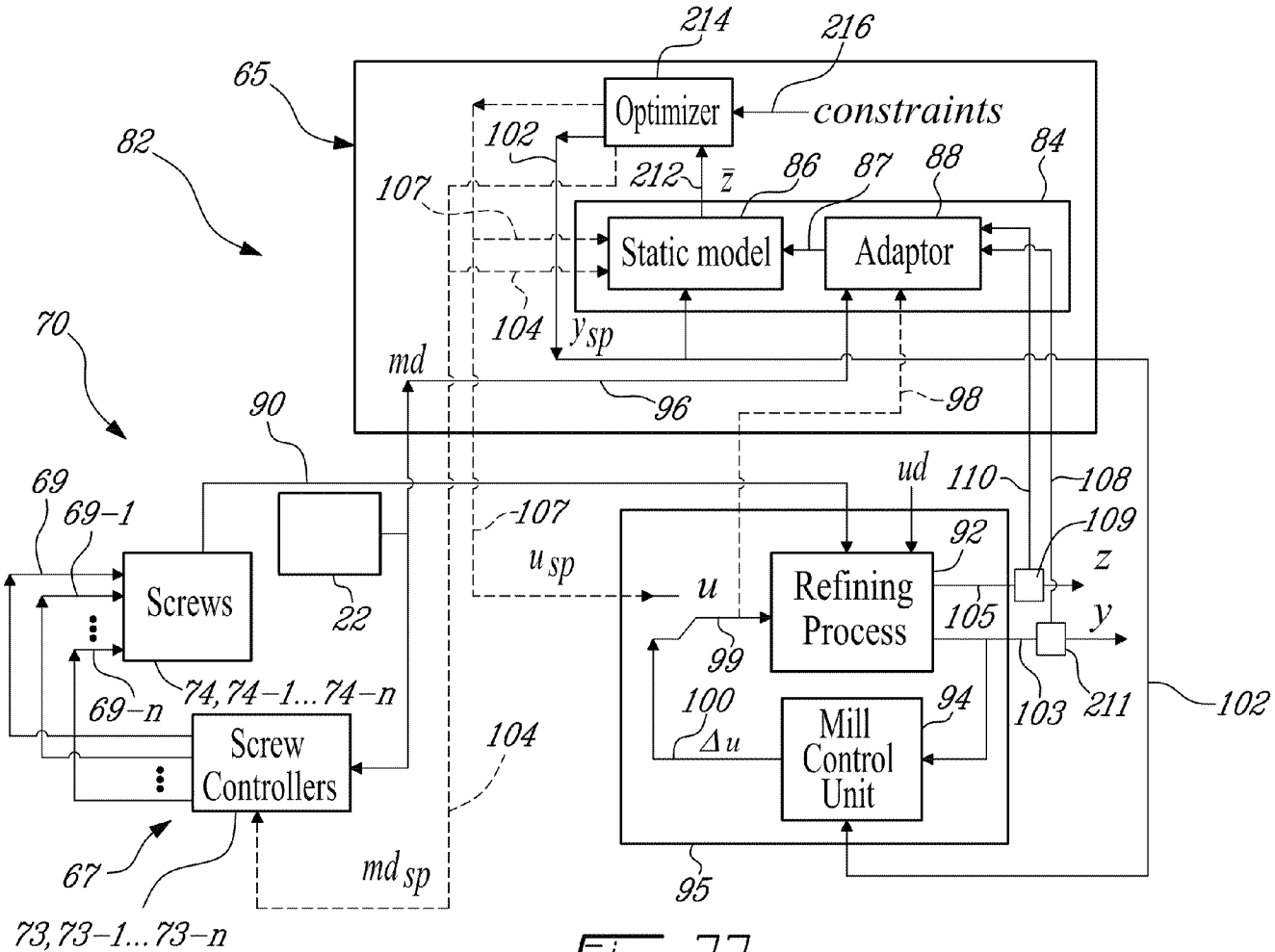
FIG. 22 is a schematic block diagram representing a chip refining optimization and control system capable of minimizing SEC.

Referring now to FIG. 22, there is shown a schematic block diagram representing a chip refining optimization and control system generally designated at 82 capable of minimizing SEC according to predetermined constraints imposed on controlled output parameters y (e.g. CSF, primary motor load), on uncontrolled output parameters z (e.g. SEC, energy split, long fiber, fines and shives contents) or on manipulated input parameters (e.g. transfer screw speed, hydraulic pressures, dilution flow rates, plate gaps, and retention time delays). The chip refining optimization and control system 82 shown in FIG. 22 basically comprises the computer 65 programmed with a predictive model 84 designed according to the specific parameters characterizing the process to be controlled, such as hydraulic pressures in refiners, refiner motor loads, production rate, total specific energy, consistency within refiners, refiner dilution flow rates, refining plate wear, etc. The predictive model 84 includes a static model 86 that can be built with a neural network, a multivariate linear model such as PLS (Projection to Latent Structures), a static gain matrix, a fuzzy logic model, or on any other appropriate modeling platform. The predictive model includes an adaptor 88 for taking into account the non-stationary nature of the refining process, by periodically updating the properties of the static model 86 as indicated by arrow 87. The predictive model 84 is validated through simulations of the chip transfer line 90, refining process 92 and mill control unit 94 in steady and dynamic modes of operation, as integrated in a simulation module 95 programmed in the computer 65.

According to the proposed approach, the degrees of freedom used to optimize refining energy are classified in three categories depending upon their respective roles in the refining operation. The first, basic category, namely the optimal control set points $Y_{sp}$, includes refining targets and targets for pulp quality-related properties, which are at high level in the control hierarchy. In a typical TMP refining process, the target for CFS as obtained with a pulp testing system such as Pulp Quality Monitor (PQM) or Pulp Expert™ from Metso Automation Canada Ltd (St-Laurent, Quebec, Canada) and the target for primary refiner motor load can be used as optimal control set points $y_{sp}$. The second category, namely optimal quality-related properties of wood chips $md_{sp}$ which are associated with measured disturbances md, may includes the target for basic density or the dry bulk density as measured by the measurement system 22 provided on the chip pile dosage stage, as well as any target for other useful measured parameters related to chip quality (e.g. brightness, moisture content, brightness, darkness, size distribution). The use of the latter category is optional and requires the integration of chip feeding screws 74, 74-1 to **74-*n* and associated screw controllers 73, 73-1 to 73-*n* for all chip piles into the optimization calculations. Otherwise, only the quality-related properties of wood chips md are fed to the predictive model from measurement system 22 through data line 96, and an independent screw control may be performed as described above in view of FIG. 20. The third category, namely optimal manipulated parameters $u_{sp}$, is also optional and includes the nominal values of manipulated parameters, which are at low level in the control hierarchy. In a typical TMP refining process, nominal values of either primary refiner transfer screw speed, hydraulic pressures, dilution flow rates or sulfonation flow rate can be used. Conveniently, the cascade-implemented control devices of the mill control unit 94 which regulate these process parameters can be modified for providing manipulated input parameter values u to the predictive model adaptor through optional data line 98 to ensure a regulation using control adjustment values $\Delta u$ (with $u=u_{sp}+\Delta u$ through data line 99) as indicated by feedback data line 100** around the optimal nominal values. Otherwise, the optimization calculations are performed without the degrees of freedom of the third category.

More specifically, the inputs of the static model basically includes $Y_{sp}$ through data line 102 as will be explained below in more detail, and optionally $md_{sp}$ or $u_{sp}$ through optional data lines 104 or 107, respectively, and the adaptor receives the measured chip properties md, the optional u values through data line 98 as well as the resulting controlled and uncontrolled output parameters y and z measured by meters 109 and 211 at outputs 103 and 105 through feedback data lines 108 and 210, respectively. Appropriate types of meters 109 and 211 are chosen depending on the nature of controlled (e.g. CSF, primary motor load), or uncontrolled (e.g. SEC, energy split, long fiber, fines and shives contents) parameters involved. For example, wattmeters can be used to measure primary motor load and energy split, while PQM or Pulp Expert™ can be used to measure CSF as well as long fiber, fines and shives contents. The output of the predictive model consists of predicted output parameters $\bar{z}$ as indicated by arrow 212, which are usually not controlled with respect to targets (e.g. SEC, energy split, long fiber, fines and shives contents). The computer 65 is further programmed with an optimizer 214 designed to minimize SEC on the basis of predetermined constraints imposed on y, z or u fed at input 216, and of predicted output parameters $\bar{z}$ received from the predictive model as indicated by arrow 212, to update the values of $Y_{sp}$ and optionally of $u_{sp}$ and $md_{sp}$. Updated values of $Y_{sp}$ are sent to static model 86 and mill control unit 94 through data line 102, while updated values of $u_{sp}$ and $md_{sp}$ are respectively directed to the refining process 92 through optional data line 107 and to the screw controllers 73, 73-1 to **73-*n* through line 104, as well as to static model 86. Once a successful process simulation is obtained, the simulation module 95** can be substituted by the actual refining process and mill control system for actual refining operation.

Conveniently, the optimizer performs its parameter updating function in accordance with a predetermined period of time $\Delta t_{opt}$ whose value may be chosen considering the mean latency time of the refining process and the reacting time of the pulp quality control loops used by the mill control unit 94. The operation of the optimizer starts at an initial time t with the acquisition of the measured disturbances md, which are used to calculate the estimated values of $Y_{sp}$ and optionally $md_{sp}$ or $u_{sp}$ that minimize for a next period of time $\Delta t_{opt}$ a predetermined function f so that min f=SEC. Since the static model 86 at the basis of the predictive model 84 can be developed from actual mill operation data covering a broad range of practicable operating conditions, the mill control unit 94 is normally capable of stabilizing the refiner operation according to the preset targets within the current period of time $\Delta t_{opt}$, and the calculations is repeated at a next time $t=t+\Delta t_{opt}$.

t is to be understood that even if the approach according to the invention has been applied in the context of a TMP or CTMP process as described above, other applications where a refiner or similar device is used for defibering lignocellulosic granular matter are contemplated, such as used in mechanical pulping and semi-mechanical pulping processes.

Applications of the present invention to a refining stage of MDF or HDF fiberboard production process are also contemplated. In such processes, refiners are used to break down the wood matter that may includes wood chips, mill waste matters such as wood shavings, sawdust or processed wood flakes (e.g. OSB flakes). into fibres (fiberize or defibrate) of predetermined size depending on the target density of the fiberboard. For example, Medium-Density Fiberboard (MDF) and Hard-Density Fiberboard (HDF) typically have density values of 500-1450 Kg/m$^3$, respectively. In a typical MDF process, the pulp (also called fibre mat) that exists from the refiner is mixed with wax to provide moisture resistance and with a resin to stop agglomeration. After drying, the mixture is pressed and cut into boards. While their respective post-refining steps are distinct, the refining modes of operation of fiberboard manufacturing and pulp and paper processes are similar, and the systems and methods as described above may also be used to provide a more cost effective and efficient fiberboard manufacturing process.

We claim:

1. A method for optimizing the operation of a lignocellulosic granular matter refining process using a control unit and at least one refiner stage, said process being characterized by a plurality of input operating parameters, at least one output parameter being controlled by said unit with reference to a corresponding control target, and at least one uncontrolled output parameter, said method comprising the steps of:

i) providing a predictive model including a simulation model for said refining process and an adaptor for said simulation model, said simulation model being based on relations involving a plurality of matter properties characterizing lignocellulosic matter to be fed to said process, said refining process input operating parameters, said controlled output parameter and said uncontrolled output parameter, to generate a predicted value of said uncontrolled output parameter;

ii) feeding the simulation model adaptor with data representing measured values of said matter properties and data representing measured values of said controlled and uncontrolled output parameters, to adapt the relations of said simulation model accordingly; and iii) providing an optimizer for generating an optimal value of said control target according to a predetermined condition on said predicted value of said uncontrolled output parameter and to one or more predetermined process constraints related to one or more of said matter properties, said refining process input operating parameters and said refining process output parameters.

2. The method according to claim 1, wherein said lignocellulosic granular matter is selected from the group consisting of wood chips, wood shavings, sawdust and processed wood flakes.

3. The method according to claim 1, wherein said uncontrolled output parameter is selected from the group consisting of specific energy consumption, energy split, long fiber, fines and shives contents.

4. The method according to claim 1, wherein said uncontrolled output parameter is specific energy consumption, said predetermined condition relates to a minimization of said refining specific energy consumption.

5. The method according to claim 4, wherein at least one of said input operating parameters is manipulated by said refining process control unit with reference to a corresponding operation target and said step ii) further includes feeding the simulation model adaptor with data representing measured values of said manipulated input operating parameter, said optimizer further generating an optimal value of said operation target according to said predetermined condition and said one or more predetermined process constraints.

6. The method according to claim 4, wherein the matter refining process is fed by a matter pile dosage stage provided with a matter flow control unit used to manipulate matter dosage parameters with reference to a corresponding target for one of said matter properties, said relations on which the simulation model is based further involving said matter dosage parameters, said optimizer further generating an optimal value of said matter property target according to said predetermined condition and said one or more predetermined process constraints.

7. The method according to claim 4, wherein said matter properties include moisture content.

8. The method according to claim 7, wherein said matter properties further include at least one density-related property.

9. The method according to claim 8, wherein said matter properties further include at least one light reflection-related property expressed as at least one optical parameter.

10. The method according to claim 9, wherein said optical parameter is luminance.

11. The method according to claim 9, wherein said optical parameter is selected from the group consisting of hue, saturation, and darkness indicator.

12. The method according to claim 9 wherein said at least one light reflection-related matter property is expressed as a plurality of optical parameters including hue, saturation and luminance.

13. The method according to claim 12, wherein said plurality of optical parameters further includes darkness indicator.

14. The method according to claim 8, wherein said matter properties further include granular matter size.

15. The method according to claim 1, wherein said simulation model is a static model built with a modelling platform selected from the group consisting of a neural network, a multivariate linear model, a static gain matrix and a fuzzy logic model.

16. The method according to claim 1, wherein said controlled output parameter is selected from the group consisting of primary motor load and pulp freeness.

17. The method according to claim 1, wherein said refining process input operating parameters are selected from the group consisting of matter transfer screw speed, dilution flow rate, hydraulic pressure, plate gaps, and retention time delays.

18. A system for optimizing the operation of a lignocellulosic refining process using a control unit, at least one output parameter meter and at least one refiner stage, said process being characterized by a plurality of input operating parameters, at least one output parameter being controlled by said unit with reference to a corresponding control target, and at least one uncontrolled output parameter, said controlled output parameter and said uncontrolled output parameter being measured by said at least one output parameter meter to generate output parameter data, said system comprising:

means for measuring a plurality of matter properties characterizing lignocellulosic matter to be fed to said process, to generate matter property data; and a computer implementing a predictive model including a simulation model for said matter refining process which is based on relations involving said plurality of matter properties, said refining process input operating parameters, said controlled output parameter and said uncontrolled output parameter, to generate a predicted value of said uncontrolled output parameter, said computer further implementing an adaptor for said simulation model receiving said matter property data and said output parameter data to adapt the relations of said simulation model accordingly, said computer further implementing an optimizer for generating an optimal value of said control target according to a predetermined condition on said predicted value of said uncontrolled output parameter and to one or more predetermined process constraints related to one or more of said matter properties, said refining process input operating parameters and said refining process output parameters.

* * * * *